US005817599A

United States Patent [19]

Iida et al.

[11] Patent Number: 5,817,599

[45] Date of Patent: Oct. 6, 1998

[54] REVERSIBLE HEAT SENSITIVE RECORDING MATERIAL

[75] Inventors: Kazuyuki Iida; Hidekazu Sano; Jun Maruyama; Masahiro Higuchi; Yukiko Shibuya, all of Tokyo, Japan

[73] Assignee: Mitsubishi Paper Mills Limited, Tokyo, Japan

[21] Appl. No.: 716,290

[22] PCT Filed: Jan. 22, 1996

[86] PCT No.: PCT/JP96/00104

§ 371 Date: Sep. 18, 1996

§ 102(e) Date: Sep. 18, 1996

[87] PCT Pub. No.: WO96/22885

PCT Pub. Date: Jan. 8, 1996

[30] Foreign Application Priority Data

| | | | |
|---|---|---|---|
| Jan. 23, 1995 | [JP] | Japan | 7-008140 |
| Feb. 16, 1995 | [JP] | Japan | 7-027864 |
| Feb. 16, 1995 | [JP] | Japan | 7-027865 |
| Mar. 17, 1995 | [JP] | Japan | 7-058359 |
| Mar. 23, 1995 | [JP] | Japan | 7-063792 |
| May 26, 1995 | [JP] | Japan | 7-126982 |

[51] Int. Cl.[6] ..... B41M 5/30

[52] U.S. Cl. ..... 503/209; 503/201; 503/209

[58] Field of Search ..... 427/150–152; 503/208, 209, 201

[56] References Cited

U.S. PATENT DOCUMENTS

| | | | |
|---|---|---|---|
| 5,395,815 | 3/1995 | Ikeda et al. | 503/216 |

FOREIGN PATENT DOCUMENTS

| | | | |
|---|---|---|---|
| 42 21 322 A1 | 1/1993 | Germany | 503/209 |
| 5-294063 | 11/1993 | Japan | 503/201 |
| 6-155905 | 6/1994 | Japan | 503/201 |
| 6-207544 | 9/1994 | Japan | 503/201 |
| 6-270545 | 9/1994 | Japan | 503/201 |
| 07052542 A | 2/1995 | Japan | 503/209 |

OTHER PUBLICATIONS

German Search Report dated Jul. 17, 1997, issued in a counterpart foreign application, together with English translation.

*Primary Examiner*—Bruce H. Hess
*Attorney, Agent, or Firm*—Pillsbury, Madison & Sutro, IP Group of Cushman, Darby & Cushman

[57] ABSTRACT

The object of the present invention is to provide a reversible heat sensitive recording material capable of formation and erasion of images with a clear contrast and capable of retaining stable images with time under the conditions of daily living. A reversible heat sensitive recording material comprising a support and, provided thereon, a normally colorless or light colored dye precursor and a reversible color developer which causes reversible change of color tone in the dye precursor due to the difference in cooling rate after heating, characterized in that said reversible heat sensitive recording material contains at least one specific color erasion accelerator containing a long chain alkyl group. Furthermore, a reversible heat sensitive recording material in which the recorded images can be erased by simple methods, such as leaving it in natural environment or at relatively low temperatures or heating it by a drier, characterized in that a specific compound having a long chain alkyl group and an imide group as the reversible color developer and a specific amine compound having a long chain alkyl group or an imide-containing compound as the color erasion accelerator are used in combination.

10 Claims, No Drawings

REVERSIBLE HEAT SENSITIVE RECORDING MATERIAL

This application claims benefit of international application PCT/JP96/00104 filed Jan. 22, 1996.

1. [Technical Field]

The present invention relates to a reversible heat sensitive recording material in which formation and erasion of an image can be carried out by controlling heat energy.

2. [Background Art]

Heat sensitive recording materials generally comprise a support and, provided thereon, a heat sensitive recording layer mainly composed of an electron donating normally colorless or light colored dye precursor and an electron accepting color developer, and, upon heating with a thermal head, a thermal pen, a laser beam or the like, the dye precursor instantaneously reacts with the color developer to produce a record image. These are disclosed in JP-B 43-4160, 45-14039, etc.

Generally, once an image is formed on these heat sensitive recording materials, it is impossible to restore them to the original state having no image by erasing the formed image. Therefore, when information is to be additionally recorded, only the way is to additionally record the information in the portion where no image is formed. Thus, in the case of the area of recording being limited, quantity of recordable information is limited and all of the necessary information cannot be recorded.

Recently, in order to cope with this problem, reversible heat sensitive recording materials in which image formation and image erasion can be repeatedly carried out have been proposed. For example, JP-A 54-119377, 63-39377 and 63-41186 disclose heat sensitive recording materials composed of a resin matrix and an organic low molecular material dispersed in the resin matrix. However, since these methods reversibly change the transparency of heat sensitive recording materials by application of heat energy, the contrast between the image portion and the non-image portion is insufficient.

Moreover, according to the methods disclosed in JP-A 50-81157 and 50-105555, since the images formed change with environmental temperatures, the temperature at which the image-forming state is maintained differs from the temperature at which the image-erasing state is maintained and, at room temperature, these two states cannot be stably maintained for an optional period of time.

Furthermore, JP-A 59-120492 discloses a method of maintaining the image-forming state and image-erasing state by keeping the recording materials in the region of hysterisis temperature utilizing hysterisis characteristics of the color forming component. However, this method suffers from the problems that a heating source and a cooling source are necessary for image formation and erasion, and further the temperature region in which image-forming state and image-erasing state can be maintained is limited to the hysterisis temperature region. Thus, this method is still unsatisfactory to be used in the temperature environment of daily living.

JP-A 2-188293 and 2-188294 and International Patent Laid-Open No. WO 90/11898 disclose reversible heat sensitive recording media comprising a leuco dye and a color developing and erasing agent which causes color formation and color erasion of the leuco dye by heating. The color developing and erasing agent is an amphoteric compound having an acidic group which allows the leuco dye to form a color and a basic group which erases the developed color. This compound carries out color formation and color erasion by preferentially exerting one of the color forming action of the acidic group and the color erasing action of the basic group by controlling the heat energy. This method, however, cannot perform complete switching between color forming reaction and color erasing reaction only by control of heat energy, and both the reactions simultaneously take place in some proportion. Therefore, sufficient color density cannot be obtained and sufficient color erasion cannot be performed. Thus, sufficient contrast of the image cannot be obtained. Furthermore, since the color erasing action of the basic group exerts also on the color formed portion at room temperature, the phenomenon of decrease in density of the color formed portion with time cannot be avoided. Moreover, JP-A 5-124360 discloses a reversible heat sensitive recording medium in which color formation of a leuco dye and erasion of the color are carried out by heating and illustrates, as electron accepting compounds, organic phosphinic acid compounds, α-hydroxy aliphatic carboxylic acids, fatty dicarboxylic acids, and specific phenol compounds such as alkylthiophenols, alkyloxyphenols, alkylcarbamoylphenols and gallic acid alkyl esters which have an aliphatic group of 12 or more carbon atoms. However, this recording medium cannot still simultaneously solve the two problems of low color density and incomplete color erasion, and, besides, it is practically unsatisfactory in stability of images with time. Furthermore, JP-A 5-294063 discloses fatty acids, waxes, higher alcohols, various esters of phosphoric acid/benzoic acid/phthalic acid or oxy acid, silicone oils, liquid crystalline compounds, surface active agents and fatty acid saturated hydrocarbons of 10 or more carbon atoms as color erasion accelerators for improving erasability of the above reversible heat sensitive recording medium. However, the effect thereof is small, and the image density after erasion is still high and the method is not practical.

As indicated above, it has been difficult by the conventional techniques to produce practical reversible heat sensitive recording materials which have a clear contrast of image, can form high density images and can completely erase the image, and can maintain images stable with time under the environment of daily living. On the other hand, as mentioned in JP-A 6-210954, the applicants have already found existence of electron accepting compounds (reversible color developers) which cause reversible change in color tone of normally colorless or light colored electron donating dye precursors by heating, namely, cause color formation and color erasion by heating. However, in order to obtain recording media capable of giving practically better image quality and capable of being easily used, there is a room for improvement in image density after color erasion, in color erasion starting temperature and in range of color erasion temperature.

It is a task of the present invention to provide heat sensitive recording materials which can carry out formation of images of high contrast and erasion of the images and can maintain images stable with time under the environment of daily living. More specifically, it is a task of the present invention to provide reversible heat sensitive recording materials according to which image density after erasion is lower, few images remain unerased, and images can be uniformly erased at a lower erasing temperature and in a wider temperature region.

[DISCLOSURE OF THE INVENTION]

As a result of intensive research conducted by the inventors in an attempt to improve erasability of a reversible heat sensitive recording material comprising a support and, provided thereon, a normally colorless or light colored dye precursor and a reversible color developer causing reversible change in color tone of the dye precursor due to the difference in cooling rate after heating, it has been found that a reversible heat sensitive recording material in which images can be completely and uniformly erased in a wide temperature region can be obtained by adding at least one of the specific compounds represented by the following formula (1), (2), (3), (4) or (5). Thus, the present invention has been accomplished.

$$A-(R^a)_h-X^a-R^b \quad (1)$$

(in formula 1, A represents a substituent having at least one nitrogen atom, $R^a$ represents a divalent hydrocarbon group of 1–12 carbon atoms, $x^a$ represents a divalent group having at least one —CONH— bond, $R^b$ represents a hydrocarbon group of 1–24 carbon atoms and may have one or more sulfur atoms in the group, with a proviso that when $R^b$ has no sulfur group, $x^a$ does not contain simple urea bond, and h represents 0 or 1).

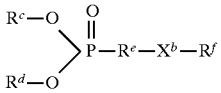

(2)

(in formula 2, $R^c$ and $R^d$ each represent a hydrocarbon group of 1–24 carbon atoms, $R^e$ represents a divalent hydrocarbon group of 1–12 carbon atoms, $R^f$ represents a hydrocarbon group of 1–28 carbon atoms and may have an oxygen atom or sulfur atom in the group, and $X^b$ represents a divalent group having at least one —CONH—bond).

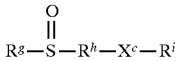

(3)

(in the formula 3, $R^g$ and $R^i$ each represent a hydrocarbon group of 1–24 carbon atoms, $R^h$ represents a divalent hydrocarbon group of 1–12 carbon atoms, and $X^c$ represents a divalent group having at least one —CONH—bond).

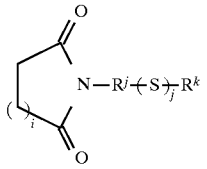

(4)

(in the formula 4, $R^j$ represents a divalent hydrocarbon group of 1–12 carbon atoms, $R^k$ represents a hydrocarbon group of 1–24 carbon atoms, i represents an integer of 1 to 3, and j represents 0 or 1).

$$R^1-(S-R^m)_k-X^d \quad (5)$$

(in the formula 5, $R^1$ represents a hydrocarbon group of 1–24 carbon atoms, $R^m$ represents a divalent hydrocarbon group of 1–12 carbon atoms, $X^d$ represents a monovalent group having at least one —COHN— bond, and k represents 0 or 1, with a proviso that in the case of k=0, $X^d$ does not contain simple amide bond).

[BEST MODE FOR CARRYING OUT THE INVENTION]

In the compound represented by the formula (1), A is a substituent having one or more nitrogen atoms and preferably a non-cyclic amino group or a nitrogen atom-containing 5- or 6-membered heterocyclic ring. Specifically, the 5-membered ring includes pyrrolidine ring, imidazolidine ring, thiazolidine ring, pyrrole ring, imidazole ring, pyrazole ring, thiazole ring or the like, and the 6-membered ring includes piperidine ring, morpholine ring, thiomorpholine ring, piperazine ring, pyridine ring, pyrimidine ring or the like, and the nitrogen atom in the ring may or may not directly bond to $R^a$. Moreover, the above amino compound residue may be substituted with a lower alkyl group, an aralkyl group, an aryl group, a hydroxyl group or the like. $R^a$ is specifically a divalent hydrocarbon group of 1–12 carbon atoms and is preferably an alkylene group. The group may contain at least one aromatic ring or may comprise only an aromatic ring. $X^a$ represents a divalent group having at least one —COHN— bond. As examples thereof, mention may be made of amide (—COHN—, —NHCO—), urethane (—NHCOO—, —OCONH—), diacylamine (—CONHCO—), diacylhydrazide (—CONHNHCO—), oxalic acid diamide (—NHCOCONH—), acylurea (—CONHCONH—, —NHCONHCO—), 3-acylcarbazic ester (—CONHNHCOO—), semicarbazide (—NHCONHNH—, —NHNHCONH—), acylsemicarbazide (—CONHNHCONH—, —NHCONHNHCO—), diacylaminomethane (—CONHCH$_2$NHCO—), 1acylamino-1-ureidomethane (—CONHCH$_2$NHCONH—, —NHCONHCH$_2$NHCO—), malonamide (—NHCOCH$_2$CONH—), and the like. However, when $R^b$ does not contain sulfur atom, the simple urea (—NHCONH—) is not included.

The following are examples of the compounds represented by the formula (1). The present invention is not limited to these compounds.

First, as examples of the compounds where A is a non-cyclic amino group, mention may be made of N-(3-diethylaminopryopyl)-11-decylthioundecanamide, 11-dodecylthioundecyl N-(3-diethylaminopropyl) carbamate, 6-diethylaminohexyl N-(2-octadecylthioethyl) carbamate, N-6-dimethylaminocaprono-N'-3-dodecylthiopropionohydrazide, 6-dicyclohexylaminocapryl 10-(dodecylthio)-decylcarbamate, 1-(3-diethylaminopropiono)-4-(10-decylthiodecyl) semicarbazide, N-4-aminocyclohexyl-N'-10-decylthiodecyloxamide, 1-(3-dimethylaminopropionylamino)-1-(11-dodecylthiodecanoylamino)methane, N-3-diethylaminopropyl-N'-10-dodecylthiodecylurea, and the like.

As examples of the compounds where $R^b$ does not contain sulfur atom and A is a nitrogen-containing 5-membered heterocyclic ring, mention may be made of N-(1-pyrrolidinyl)tetradecanamide, octadecyl N-(1-pyrrolidinyl) carbamate, [2-(1-pyrrolidinyl)ethyl]N-octadecylcarbamate, N-[3-(1-pyrrolidinyl)propiono)]-N'-tetradecanohydrazide, [3-(3-methylimidazolidinyl)propyl]N-octadecylcarbamate, N-octadecyl-3-(3-thiazolidinyl)-propanamide, 1-[6-(1-pyrrolyl)hexanoyl]-4-tetradecylsemicarbazide, N-[2-(4-imidazolyl)ethyl]-N'-octadecyloxamide, 1-[3-(1-imidazolyl)propionylamino]-1-tetradecanoylaminomethane, N-[11-(1-pyrazolyl)-undecanoyl]-N'-octadecylurea, and the like.

Next, as examples of the compounds where $R^b$ does not contain sulfur atom and A is a nitrogen-containing 6-membered heterocyclic ring, mention may be made of hexadecyl N-piperidinocarbamate, N-(2-piperidinoethyl) octadecanamide, (2-piperidinoethyl) N-octadecylcarbamate, hexadecyl N-(2-piperidinoethyl)carbamate, N-(3-piperidinopropiono)-N'-octadecanohydrazide, 1-(3-piperidinopropionyl)-3-octadecylsemicarbazide, N-(11-piperidinoundecano)-N'-decanohydrazide, N-[2-(1-methyl) piperidinyl]carbo-N'-octadecanohydrazide, hexadecyl N-[4-

(1-benzyl)piperidino]carbamate, hexadecyl N-[2-(4-hydroxypiperidino)ethyl]carbamate, hexadecyl N-morpholinocarbamate, N-(3-morpholinopropyl) octadecanamide, (2-morpholinoethyl) N-octadecylcarbamate, hexadecyl N-(2-morpholinoethyl)carbamate, N-(3-morpholinopropiono)-N'-octadecanohydrazide, N-(3-morpholinopropiono)-N'-docosanohydrazide, N-(3-morpholinopropyl)-N'-octadecyloxamide, 1-(3-morpholinopropionyl)-4-octadecylsemicarbazide, hexadecyl 3-(6-morpholinohexanoyl)carbazinate, N-[p-(morpholinomethyl)benzo]-N'-octadecanohydrazide, hexadecyl N-(p-piperidinophenyl)carbamate, N-(p-morpholinophenyl)-N'-octadecyloxamide, N-(11-morpholinoundecano)-N'-decanohydrazide, N-(11-morpholinoundecano)-N'-octadecanohydrazide, (2-thiomorpholinoethyl) N-octadecylcarbamate, N-(3-thiomorpholinopropiono)-N'-octadecanohydrazide, 1-(11-thiomorpholinoundecanyl)-4-decylsemicarbazide, hexadecyl N-(4-methylpiperadinyl)carbamate, N-(4-methylpiperadinyl)-N'-octadecyloxamide, N-[2-(4-methylpiperadinyl)ethyl]-N'-octadecyloxamide, 1-[3-(4-methylpiperadinyl)propionylamino]-1-octadecanoylaminomethane, N-[2-(1,4-dimethyl) piperadinyl]carbo-N'-octadecanohydrazide, 1-octadecanoyl-4-[2-(4-benzylpiperadinyl)ethyl] semicarbazide, N-[2-(4-phenylpiperadinyl)ethyl]-N'-octadecylmalondiamide, hexadecyl N-(2-pyridyl) carbamate, N-(2-pyridyl)-N'-dodecyloxamide, 1-(4-pyridinecarbonylamino)-1-(N'-octadecylureido)methane, and the like.

As examples of the compounds where $R^b$ contains a sulfur atom and A is a heterocyclic ring, mention may be made of 2-(1-pyrrolidinyl)ethyl N-(2-dodecylthio)ethylcarbamate, N-3-pyrrolidinylpropiono-N'-11-decylthioundecanohydrazide, N-5-1H-tetrazolyl-N'-10-decylthiodecylurea, N-2-thiazolyl-N'-10-dodecylthiodecyloxamide, 1-(11-dodecylthioundecano)-4-(2-thiazolinyl)semicarbazide, 6-octadecylthiohexyl N-piperidinocarbamate, N-[2-(1-piperidino)ethyl]-11-cyclohexylthioundecanamide, 2-(1-piperidino)ethyl N-(10-decylthiodecyl)carbamate, N-[3-(1-piperidino)propiono]N'-3-dodecylthiopropionohydrazide, 1-[3-(1-piperidino) propiono]-4-(10-decylthiodecyl)semicarbazide, N-[11-(1-piperidino)undecano]-N'-3-dodecylthiopropionohydrazide, N-(4-piperidinyl)carbo-N'-11-dodecylthiounde canohydrazide, 1-[4-(1-methyl)piperidinylcarbo]-4-(10-dodecylthiodecyl)semicarbazide, N-[2-(4-hydroxy-1-piperidinyl)ethyl]-11-dodecylthioundecanamide, N-(2-morpholinoethyl)-11-decylthioundecanamide, 6-morpholinohexyl N-(10-dodecylthiodecyl)carbamate, 2-morpholinoethyl N-10-decylthiodecylcarbamate, N-11-morpholinoundecano-N'-3-cyclohexylthiopropiono hydrazide, N-3-morpholinopropyl-N'-10-decylthio decyloxamide, N-11-dodecylthioundecyloxycarbo-N'-3-morpholinopropionohydrazide, N-(3-morpholinopropyl)-3-dodecylthiopropanamide, 1-(3-morpholinopropionylamino)-1-(11-decylthiopropionylamino)methane, N-2-morpholinoethyl-N'-10-decylthiodecylmalondiamide, and the like.

In the compounds represented by the formula (2), $R^c$ and $R^d$ are hydrocarbon groups of 1–24 carbon atoms, and these may be the same or different. $R^e$ is a divalent hydrocarbon group of 1–12 carbon atoms and is preferably an alkylene group. The group may contain an aromatic ring or may comprise only an aromatic ring. $R^f$ represents a hydrocarbon group of 1–28 carbon atoms and is preferably an aliphatic hydrocarbon group. When $R^f$ contains an oxygen atom or sulfur atom, $R^f$ is represented by $—R^{f1}—O—R^{f2}$ or $—R^{f1}—S—R^{f2}$ where $R^{f1}$ and $R^{f2}$ represent an alkylene group and an alkyl group, the sum of carbon atoms in these two groups being 2 to 28. Especially preferably, the sum of the carbon atoms in $R^c$, $R^d$, $R^e$ and $R^f$ ($R^{f1}$ and $R^{f2}$) is from 18 to 64. $X^b$ represents a divalent group having at least one —COHN—bond, and examples thereof are amide (—COHN—, —NHCO—), urea (—NHCONH—), urethane (—NHCOO—, —OCONH—), diacylamine (—CONHCO—), diacylhydrazide (—CONHNHCO—), oxalic diamide (—NHCOCONH—), acylurea (—CONHCONH—, —NHCONHCO—), 3-acylcarbazinic ester (—CONHNHCOO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1acylamino-1-ureidomethane (—$CONHCH_2NHCONH$—, —$NHCONHCH_2NHCO$—), malonamide (—$NHCOCH_2CONH$—), and the like. When $X^b$ is urea, urethane, and diacylhydrazide, the compounds can be produced inexpensively and these compounds are especially preferred.

As examples of the compounds represented by the formula (2), mention may be made of the following compounds.

They are N-[3-(dimethoxyphosphoryl)propyl] octadecanamide, N-tetradecyl-3-(diethoxyphosphoryl) propanamide, N-[2-(dimethoxyphosphoryl)ethyl]-N'-tetradecylurea, N-[3-(diethoxyphosphoryl)propyl]-N'-octadecylurea, N-[3-(dibutoxyphosphoryl)propyl]-N'-octadecylurea, N-[p-(dibutoxyphosphoryl)phenyl]-N'-docosylurea, N-[3-(diethoxyphosphoryl)propyl]-N'-(10-decyloxydecyl)urea, hexadecyl N-[3-(dimethoxyphosphoryl)propyl]carbamate, hexadecyl N-[3-(diethoxyphosphoryl)propyl]carbamate, [3-(diethoxyphosphoryl)propyl]N-octadecylcarbamate, [3-(diethoxyphosphoryl)propyl]N-(3-octadecylthiopropyl) carbamate, N-octadecanoyl-3-(diethoxyphosphoryl) propanamide, N-[3-(dimethoxyphosphoryl)propiono]-N'-octadecanohydrazide, N-[3-(diethoxyphosphoryl) propiono]- N'-octadecanohydrazide, N-[11-(diethoxyphosphoryl)undecano]-N'-octanohydrazide, N-[3-(dibutoxyphosphoryl)propiono]-N'-tetradecanohydrazide, N-[3-(dioctyloxyphosphoryl)propiono]-N'-decanohydrazide, N-[3-(didodecyloxyphosphoryl) propiono]-N'-octanohydrazide, N-[p-(diethoxyphosphoryl-methyl)benzo]-N'-docosanohydrazide, [3-(diethoxyphosphoryl)propiono]-N'-(11-decylthioundecano)-hydrazide, N-[3-(diethoxyphosphoryl)propionyl]-N'-octadecyloxamide, N-[3-(dibutoxyphosphoryl)propionyl] N'-tetradecyloxamide, N-[3-(diethoxyphosphoryl) propionyl]-N'-octadecylurea, N-[3-(diethoxyphosphoryl) propyl]-N'-octadecanoylurea, hexadecyl 3-[3-(diethoxyphosphoryl)propionyl]carbazinate, 1-tetradecyl-4-[3-diethoxyphosphoryl)propyl]semicarbazide, 1-[3-(diethoxyphosphoryl)propiono]-4-octadecylsemicarbazide, 1-[11-(dibutoxyphosphoryl)undecano]-4-octadecylsemicarbazide, 1-[3-(diethoxyphosphoryl) propionylamino]-1-octadecanoylaminomethane, 1-[3-(dibutoxyphosphoryl)propionylamino]1-(N'-octadecylureido)methane, N-[3-(diethoxyphosphoryl) propionyl] -N'-octadecylmalonamide, and the like.

In the compounds represented by the formula (3), $R^g$ and $R^i$ each represent a hydrocarbon group of 1–24 carbon atoms. $R^h$ is specifically a divalent hydrocarbon group of 1–12 carbon atoms, and preferably an alkylene group. The group may contain an aromatic ring or may comprise only an aromatic ring. The sum of the carbon atoms in $R^g$, $R^h$ and $R^i$ is preferably 20–40. $X^c$ represents a divalent group having at least one —COHN— bond, and examples thereof are amide (—COHN—, —NHCO—), urea (—NHCONH—), urethane (—NHCOO—, —OCONH—), diacylamine (—CONHCO—), diacylhydrazide (—CONHNHCO—), oxalic diamide (—NHCOCONH—), acylurea (—CONHCONH—, —NHCONHCO—), 3-acylcarbazic ester (—CONHNHCOO—), semicarbazide (—NHCONHNH—, —NHNHCONH—), acylsemicarbazide (—CONHNHCONH—, —NHCONHNHCO—), diacylaminomethane (—CONHCH$_2$NHCO—), 1acylamino-1-ureidomethane (—CONHCH$_2$NHCONH—, —NHCONHCH$_2$NHCO—), malonamide (—NHCOCH$_2$CONH—), and the like.

Examples of the compounds represented by the formula (3) include the following compounds. The present invention is not limited to these exemplified compounds.

That is, as examples of the compound, mention may be made of N-[2-(propylsulfinylethyl)]octadecanamide, N-hexadecyl[2-(propylsulfinylethane)]amide, N-[3-(methylsulfinyl)propyl]-N'-octadecylurea, N-[2-(octylsulfinyl)ethyl]-N'-decylurea, hexadecyl N-[2-(methylsulfinyl)ethyl]carbamate, [4-(methylsulfinyl)butyl] N-hexadecylcarbamate, N-[2-(propylsulfinyl)acetyl] octadecanamide, N-[3-(methylsulfinyl)propionyl]-N'-octadecanohydrazide, N-[4-(hexylsulfinyl)butyryl]-N'-dodecanohydrazide, N-[3-(methylsulfinyl)propyl]-N'-octadecyloxamide, N-[p-(decylsulfinyl)phenyl]-N'-octadecyloxamide, N-[11-(methylsulfinyl)undecanoyl]-N'-decylurea, N-hexadecanoyl-N'-[3-(butylsulfinyl)propyl] urea, hexadecyl 3-[3-(methylsulfinyl)propionyl]carbazinate, 1-[2-(decylsulfinyl)acetyl]-4-octadecylsemicarbazide, 1-dodecano-4-[3-(dodecylsulfinyl)propyl]semicarbazide, 1-[3-ethylsulfinyl)propionylamino]-1-octadecanoylaminomethane, 1-[p-(butylsulfinyl) benzoylamino]-1-(N'-octadecylureido)methane, N-[2-(propylsulfinyl)ethyl]-N'-octadecylmalonamide, and the like.

In the compounds represented by the formula (4), i represents an integer of 1 to 3, and preferred are compounds in which i represents 1 or 2, namely, 5- or 6-atom ring forming compounds. $R^j$ is specifically a divalent hydrocarbon group of 1–12 carbon atoms, and preferably represents an alkylene group. The group may contain an aromatic ring or may comprise only an aromatic ring. j indicates presence or absence of sulfur atom.

Examples of the compounds represented by the formula (4) include the following compounds. The present invention is not limited to these compounds.

As examples of the compounds where i is 1, mention may be made of N-tetradecylsuccinimide, N-hexadecylsuccinimide, octadecylsuccinimide, N-docosylsuccinimide, N-dodecylglutarimide, N-(4-heptylphenyl)glutarimide, N-tetradecylglutarimide, N-hexadecylglutarimide, N-octadecylglutarimide, N-docosylglutarimide, N-dodecyladipinimide, N-octadecyladipinimide, and the like.

As examples of the compounds where i is 2, mention may be made of N-(2-decylthio)ethylsuccinimide, N-(2-dodecylthio)ethylsuccinimide, N-(2-octadecylthio) ethylsuccinimide, N-(3-decylthio)propylsuccinimide, N-(3-dodecylthio)propylsuccinimide, N-(3-octadecylthio) propylsuccinimide, N-(5-octylthio)pentylsuccinimide, N-(5-decylthio)pentylsuccinimide, N-(5-dodecylthio) pentylsuccinimide, N-(5-octadecylthio)pentylsuccinimide, N-(10-octylthio)decylsuccinimide, N-(10-decylthio) decylsuccinimide, N-(10-dodecylthio)decylsuccinimide, N-(10-octadecylthio)decylsuccinimide, N-(4-dodecylthio) phenylsuccinimide, N-(4-dodecylthio)phenylsuccinimide, N-(4-octadecylthio)phenylsuccinimide, N-(2-cyclohexylthio)ethylsuccinimide, N-(3-cyclohexylthio) propylsuccinimide, N-(5-cyclohexylthio)pentylsuccinimide, N-(10-cyclohexylthio)decylsuccinimide, N-(4-cyclohexylthio)phenylsuccinimide, N-(2-decylthio) ethylglutarimide, N-(2-dodecylthio)ethylglutarimide, N-(2-octadecylthio)ethylglutarimide, N-(3-decylthio) propylglutarimide, N-(3-dodecylthio)propylglutarimide, N-(octadecylthio)propylglutarimide, N-(5-octylthio) pentylglutarimide, N-(5-decylthio)pentylglutarimide, N-(5-dodecylthio)pentylglutarimide, N-(5-octadecylthio) pentylglutarimide, N-(10-octylthio)decylglutarimide, N-(10-decylthio)decylglutarimide, N-(10-dodecylthio) decylglutarimide, N-(10-octadecylthio)decylglutarimide, N-(4-dodecylthio)phenylglutarimide, N-(4-dodecylthio) phenylglutarimide, N-(4-octadecylthio)phenylglutarimide, N-(2-cyclohexylthio)ethylglutarimide, N-(3-cyclohexylthio)propylglutarimide, N-(5-cyclohexylthio) pentylglutarimide, N-(10-cyclohexylthio)decylglutarimide, N-(4-cyclohexylthio)phenylglutarimide, N-(2-decylthio) ethyladipinimide, N-(2-dodecylthio)ethyladipinimide, N-(2-octadecylthio)ethyladipinimide, N-(3-decylthio) propyladipinimide, N-(3-dodecylthio)propyladipinimide, N-(octadecylthio)propyladipinimide, N-(5-octylthio) pentyladipinimide, N-(5-decylthio)pentyladipinimide, N-(5-dodecylthio)pentyladipinimide, N-(5-octadecylthio) pentyladipinimide, N-(10-octylthio)decyladipinimide, N-(10-decylthio)decyladipinimide, N-(10-dodecylthio) decyladipinimide, N-(10-octadecylthio)decyladipinimide, N-(4-dodecylthio)phenyladipinimide, N-(4-dodecylthio) phenyladipinimide, N-(4-octadecylthio)phenyladipinimide, N-(2-cyclohexylthio)ethyladipinimide, N-(3-cyclohexylthio)propyladipinimide, N-(5-cyclohexylthio) pentyladipinimide, N-(10-cyclohexylthio)decyladipinimide, N-(4-cyclohexylthio)phenyladipinimide, and the like.

In the compounds represented by the formula (5), $X^d$ represents a monovalent group having at least one —COHN— bond, and examples thereof are amide (—CONH$_2$), urea (—NHCONH$_2$), urethane (—OCONH$_2$), acylhydrazide (—CONHNH$_2$), oxalic diamide (—NHCOCONH$_2$), acylurea (—CONHCONH$_2$), carbazinic ester (—OCONHNH$_2$), semicarbazide (—NHCONHNH$_2$), 1-acylsemicarbazide (—CONHNHCONH$_2$), 1acylamino-1--ureidomethane (—CONHCH$_2$NHCONH$_2$), malonamide (—NHCOCH$_2$CONH$_2$), and the like. However, in the case of k=0, $X^d$ does not include the simple amide (—CONH$_2$). $R^m$ represents a divalent hydrocarbon group of 1–12 carbon atoms, preferably an alkylene group, and may contain an aromatic ring or may comprise only an aromatic ring. Furthermore, in the case of k=0, especially preferably, the carbon number of $R^1$ is at least 12, and in the case of k=1, especially preferably, the sum of the carbon numbers of $R^1$ and $R^m$ is 16–30.

As examples of the compounds represented by the formula (5), mention may be made of the following compounds, to which the present invention is not limited.

First, examples of the compounds of k=0 are octadecanohydrazide, docosanohydrazide, octadecylurea, hexadecylurea, dodecylurea, hexadecyl carbamate, dodecyl carbamate, N-octadecanourea, N-tetradecanourea, hexadecyl carbazinate, docosyl carbazinate, N-octadecyloxamide, N-dodecyloxamide, 4-octadecylsemicarbazide, 4-hexadecylsemicarbazide, 1-tetradecanosemicarbazide, 1-octadecanosemicarbazide, 1-docosanosemicarbazide, 3-(octadecylamino)oxalylhydrazine, 3-(tetradecylamino) oxalylhydrazine, 1-(octadecylaminocarbonyl) semicarbazide, 1-(hexadecylaminocarbonyl)semicarbazide, N-octadecylmalondiamide, N-docosylmalondiamide, 1-octadecanoamino-1-ureidomethane,1-hexadecanoamino-1-ureidomethane, and the like.

Examples of the compounds of k=l are 3-(octadecylthio) propionamide, 11-(decylthio)undecanamide, 6-(tetradecylthio)hexanamide, 11-(octadecylthio) undecanamide, 2-(hexadecylthio)acetamide, 3-(docosylthio) propionohydrazide, 11-(octadecylthio)undecanohydrazide, 6-(dodecylthio)hexanohydrazide, N-[2-(octadecylthio) ethyl]urea, N-[2-(tetradecylthio)ethyl]urea, N-[2-(hexadecylthio)ethyl]oxamide, N-[4-(dodecylthio)butyl] oxamide, [1-(octylthio)decyl]carbamate, [12-(undecylthio) dodecyl]carbamate, [10-(hexylthio)decyl]carbazinate, [4-(docosylthio)butyl]carbazinate, 4-[3-(octadecylthio)propyl] semicarbazide, 4-[3-(decylthio)decyl]semicarbazide,1-[6-(dodecylthio)hexano]semicarbazide, 1-[4-(hexadecylthio) butano]semicarbazide, 1-[3-(tetradecylthio) propionylamino]ureide, 1-[8-(tetradecylthio) octanoylamino]ureide, N-[11-(docosylthio)undecanoyl] malonamide, N-[3-(hexadecylthio)propionyl]malonamide, p-(octadecylthio)benzamide, p-[(hexadecylthio)methyl] benzamide, p-(tetradecylthio)benzhydrazide, p-(octadecylthio)phenylacetohydrazide, and the like.

Amount of the compound represented by the formula (1), (2), (3), (4) or (5) is preferably 0.5–1000% by weight, more preferably 1–200% by weight based on the dye precursor, and, furthermore, most preferably, 5–100% by weight based on the dye precursor from the point of heat resistant storage stability. The compound represented by the formula (1), (2), (3), (4) or (5) may be used each alone or in combination of two or more.

The reversible color developer used in the present invention is unlimited, and, for example, color developing and erasing agents disclosed in JP-A 2-188293 and 2-188294 and International Patent Laid-Open No. WO90/11898 and reversible color developers such as organic phosphoric acids, carboxylic acids or phenol compounds disclosed in JP-A 5-124360 can also be used, but the compound represented by the following formula (7) is especially preferred from the points of color density and color erasability. Furthermore, those which are outside the above-mentioned scope can also be used as far as they have the similar properties to those of the compounds of the formula (7). The process for synthesis of the compound of the formula (7) is described in JP-A 6-210954 and JP-Appln. 5-160547, 5-256825, 5-317555, 5-328101 and 6–10310 filed by the present applicant.

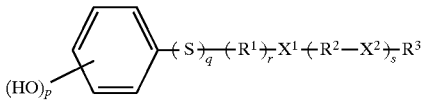

(7)

(in the formula 7, p represents an integer of 1 to 3, q, r and s each represent 0 or 1, with a proviso that when q is 1, r represents 1, $R^1$ and $R^2$ each represent a divalent hydrocarbon group of 1–18 carbon atoms, $R^3$ represents a hydrocarbon group of 1–24 carbon atoms, $X^1$ represents a divalent group having at least one —COHN—bond, and $X^2$ represents a divalent group having at least one —COHN— bond, an oxygen atom or a sulfur atom).

In the compounds represented by the formula (7), $R^1$ and $R^2$ each represent a divalent hydrocarbon group of 1–18 carbon atoms and may contain an aromatic ring or may comprise only an aromatic ring. Examples of the divalent group having at least one —COHN— bond which is represented by $X^1$ and $X^2$ are amide (—COHN—, —NHCO—), urea (—NHCONH—), urethane (—NHCOO—, —OCONH—), diacylamine (—CONHCO—), diacylhydrazide (—CONHNHCO—), oxalic diamide (—NHCOCONH—), acylurea (—CONHCONH—, —NHCONHCO—), 3-acylcarbazinic ester (—CONHNHCOO—), semicarbazide (—NHCONHNH—, —NHNHCONH—), acylsemicarbazide (—CONHNHCONH—, —NHCONHNHCO—), diacylaminomethane (—CONHCH$_2$NHCO—), 1acylamino-1-ureidomethane (—CONHCH$_2$NHCONH—, —NHCONHCH$_2$NHCO—), malonamide (—NHCOCH$_2$CONH—), and the like.

The compounds represented by the formula (7) are electron accepting compounds, and they have an ability to cause color formation of leuco dyes while peculiarly they also have a color erasing effect, namely, they have a reversible effect. No such reversible effect is seen in electron accepting compounds used for ordinary heat sensitive recording materials, namely, 2,2-bis(4-hydroxyphenyl)propane, bis(4-hydroxyphenyl)sulfone, benzyl 4-hydroxybenzoate, etc. Examples of the electron accepting compounds represented by the formula (7) are shown below. The present invention is not limited to these compounds.

Examples of the compounds of the formula (7) where q=0/r=0/s=0 are 4'-hydroxyhexadecananilide, N-octadecyl-4-hydroxybenzamide, N-(4-hydroxyphenyl)-N'-octadecylurea, N-(4-hydroxybenzo)-N'-octadecanohydrazide, N-(3,4-dihydroxyphenyl-N'-octadecyloxamide, and the like.

Examples of the compounds of the formula (7) where q=0/r=1/s=0 are N-[2-(4-hydroxyphenyl)ethyl]-N'-octadecylurea, N-[3-(4-hydroxyphenyl)propiono]-N'-octadecanohydrazide, N-[3-(4-hydroxyphenyl)propiono]-N'docosanohydrazide, 1-[3-(4-hydroxyphenyl)propionyl] amino-1-octadecanoylaminomethane, 1-(4-hydroxyphenylacetyl)-4-octadecylsemicarbazide, and the like.

Examples of the compounds of the formula (7) where q=1/r=1/s=0 are N-hexadecyl-(4-hydroxyphenylthio) acetamide, N-[2-(4-hydroxyphenylthio)ethyl]-N'-octadecylurea, N-(4-hydroxyphenylthio)aceto-N'-docosanohydrazide, N-[11-(4-hydroxyphenylthio) undecano]N'-decanohydrazide, N-[2-(4-hydroxyphenylthio) ethyl]-N'-octadecyloxamide, N-[4-(4-hydroxyphenylthio) phenyl]-N'-octadecyloxamide, N-[4-(4-hydroxyphenylthiomethyl)benzo]-N'-docosanohydrazide, and the like.

Examples of the compounds of the formula (7) where q=0/r=0/s=1 are N-(4-hydroxyphenyl)-3-dodecylthiopropanamide, N-(4-hydroxyphenyl)-N'-3-octadecylthiopropylurea, 4-hydroxy-4'-octadecyloxybenzanilide, 4-hydroxy-4'-dodecylthiobenzanilide, 2-(4-octadecanoylaminophenyl)-4'-hydroxyacetanilide, 2-[4-(N'-octadecylureido)phenyl]-4'-hydroxyacetanilide, and the like.

Examples of the compounds of the formula (7) where q=0/r=1/s=1 are N-[3-(4-hydroxyphenyl)propiono]N'-(3-dodecylthiopropiono)hydrazide, N-[3-(3,4-dihydroxyphenyl)propiono]-N'-(11-decylthioundecano) hydrazide, and the like.

Examples of the compounds of the formula (7) where q=1/r=1/s=1 are N-[3-(4-hydroxyphenylthio)propiono]-N'-(3-octadecylthiopropiono)hydrazide, N-[11-(3,4,5-trihydroxyphenylthio)undecano]-N'-(11-octadecylundecano)hydrazide, and the like.

These reversible color developers may be used each alone or in combination of two or more. The amount of the reversible color developer is 5–5000% by weight, preferably 10–3000% by weight based on the dye precursor.

As the electron donating normally colorless or light colored dye precursors used in the present invention, representative are known compounds which are generally used for pressure sensitive recording sheets or heat sensitive recording sheets and they are unlimited. Examples of the dye precursors are enumerated below. The present invention is not limited to these dye precursors.

(1) Triarylmethane compounds 3,3-Bis(p-dimethylaminophenyl)-6-dimethylaminophthalide (crystal violet lactone), 3,3-bis(p-dimethylaminophenyl) phthalide, 3-(p-dimethylaminophenyl)-3-(1,2-dimethylindol-3-yl) phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, and the like.

(2) Diphenylmethane compounds 4,4'-Bis(dimethylaminophenyl)benzhydrylbenzyl ether, N-chlorophenylleucoauramine, N-2,4,5-trichlorophenylleucoauramine, and the like.

(3) Xanthene compounds

Rhodamine B anilinolactam, Rhodamine-B-p-chloroanilinolactam, 3-diethylamino-7-dibenzylamino-7-dibenzylaminofluoran, 3-diethylamino-7-octylaminofluoran, 3-diethylamino-7-phenylfluoran, 3-diethylamino-7-chlorofluoran, $^{3}$-diethylamino-6-chloro-7-methylfluoran, 3-diethylamino-7-(3,4-dichloroanilino) fluoran, 3-diethylamino-7-(2-chloroanilino)fluoran, 3-diethylamino6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-butylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl)amino-6-methyl-7-anilinofluoran, and the like.

(4) Thiazine compounds

Benzoylleucomethylene blue, p-nitrobenzoylleucomethylene blue, and the like.

(5) Spiro compounds

3-Methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, and the like.

These normally colorless or light colored dye precursors are used each alone or in combination of two or more.

It has been found that a reversible heat sensitive recording material in which erasion of images can be completely and uniformly performed in the natural environment or in the area of low temperature close to the natural environment can be obtained by combining the above-mentioned specific color erasion accelerator with the specific reversible color developer. Specifically, by using a normally colorless or light colored dye precursor and a compound represented by the following formula (6) as a reversible color developer in combination with at least one of the compounds represented by the above formula (1) or (4) as a color erasion accelerator, a reversible heat sensitive recording material can be obtained in which the printed image can be erased by relatively simple methods, such as a method of leaving it in the natural environment without heating and a method of heating it by a dryer which is an essential in everyday life, and others.

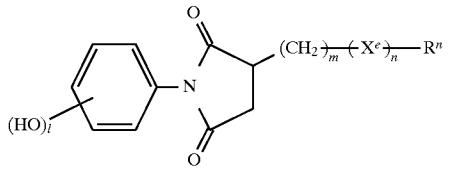

(6)

(in the formula 6, 1 represents an integer of 1 to 3, m represents an integer of 0 to 3, $x^e$ represents an oxygen or sulfur atom, n represents 0 or 1, and $R^n$ represents a hydrocarbon group of 10–24 carbon atoms).

Examples of the reversible color developer represented by the formula (6) which causes reversible change in color tone of the normally colorless or light colored electron donating dye precursor are enumerated below. The present invention is not limited to these color developers.

That is, mention may be made of n-tetradecylsuccinic acid [N-(4-hydroxyphenyl)]imide, n-hexadecylsuccinic acid [N-(4-hydroxyphenyl)]imide, n-octadecylsuccinic acid [N-(4-hydroxyphenyl)]imide, n-docosenylsuccinic acid [N-(4-hydroxyphenyl)]imide, (n-octadecyloxy)succinic acid [N-(4-hydroxyphenyl)]imide, (n-tetradecylthio)succinic acid [N-(4-hydroxyphenyl)]imide, n-(octadecylthio)succinic acid [N-(4-hydroxyphenyl)]imide, [(n-octadecylthio)] methylsuccinic acid [N-(4-hydroxyphenyl)]imide, [2-(n-hexadecylthio)ethyl]succinic acid [N-(4-hydroxyphenyl)] imide, [3-(n-dodecyloxy)propyl]succinic acid [N-(4-hydroxyphenyl)]imide, and the like.

These reversible color developers may be used each alone or in combination of two or more. The amount of the electron accepting compound is 5–5000% by weight, preferably 10–3000% by weight based on the normally colorless or light colored dye precursor.

As an example of the method for producing the reversible heat sensitive recording material of the present invention, mention may be made of a method of coating on a support the dye precursor and the reversible color developer as main components and additionally the compound of the present invention, thereby to form a reversible heat sensitive recording layer.

As examples of the method for preparing a coating liquid to contain the dye precursor, the reversible color developer and the compound of the present invention in the reversible heat sensitive recording layer, mention may be made of a method of dissolving the compounds each alone in solvents or dispersing them in dispersing media and, then, mixing the solutions or dispersions, a method of mixing the compounds and, then, dissolving the mixture in a solvent or dispersing it in a dispersing medium, and a method of dissolving and homogenizing the compounds by heating and dissolving it in a solvent or dispersing it in a dispersing medium, but these are unlimited. If necessary, a dispersant may be used at the time of dispersing. Water-soluble polymers such as polyvinyl alcohol or various surface active agents can be utilized as a dispersant when water is used as a dispersing medium. In the case of aqueous dispersion, water-soluble organic solvents such as ethanol may be added. In addition, when the dispersing medium is an organic solvent represented by a hydrocarbon, lecithin, phosphate ester or the like may be used as a dispersant.

Furthermore, binders may be added to the reversible heat sensitive recording layer for improving strength of the reversible heat sensitive recording layer. As examples of the binders, mention may be made of water-soluble polymers such as starches, hydroxyethylcellulose, methylcellulose, carboxymethylcellulose, gelatin, casein, polyvinyl alcohol, modified polyvinyl alcohol, sodium polyacrylate, acrylamide/acrylate copolymer, acrylamide/acrylate/methacrylic acid terpolymer, alkali salt of styrene/maleic anhydride copolymer, and alkali salt of ethylene/maleic anhydride copolymer, latexes such as polyvinyl acetate, polyurethane, polyacrylate ester, styrene/butadiene copolymer, acrylonitrile/butadiene copolymer, methyl acrylate/butadiene copolymer, ethylene/vinyl acetate copolymer, ethylene/vinyl chloride copolymer, polyvinyl chloride, ethylene/vinylidene chloride copolymer, polyvinylidene chloride, and the like.

Moreover, as additives for adjusting color forming sensitivity of the reversible heat sensitive recording layer, heat-meltable materials can be contained in the reversible heat sensitive recording layer. Preferred are those which have a melting point of 60°–200° C., and especially preferred are those which have a melting point of 80°–180° C. Sensitizers used for general heat sensitive recording sheets can also be used. As these compounds, there may be used waxes such as N-hydroxymethylstearic acid amide, behenic acid amide, stearic acid amide and palmitic acid amide; naphthol derivatives such as 2-benzyloxynaphthalene; biphenyl derivatives such as p-benzylbiphenyl and 4-allyloxybiphenyl; polyether compounds such as 1,2-bis(3-methylphenoxy)ethane, 2,2'-bis(4-methoxyphenoxy)diethyl ether and bis(4-methoxyphenyl) ether; carbonic acid or oxalic acid diester derivatives such as diphenyl carbonate, dibenzyl oxalate and bis(p-methylbenzyl) oxalate; and the like. These may be used each alone or in combination of two or more.

As the supports used for the reversible heat sensitive recording materials of the present invention, depending on the purposes, there may be optionally used paper, various nonwoven fabrics, woven fabrics, synthetic resin films such as polyethylenanderephthalate and polypropylene, papers laminated with synthetic resins such as polyethylene and polypropylene, synthetic papers, metallic foils, and glasses, and composite sheets comprising combination of them. These are not limiting. These may be opaque, translucent or transparent. In order for the background appearing to have white or other specific colors, a white pigment, a colored dye or pigment or air bubbles may be contained in the support or provided on the surface of the support. When the hydrophilicity of the support is small and it is difficult to coat the reversible heat sensitive recording layer on the support in the case of carrying out aqueous coating of the film or the like, the surface of the support may be subjected to a treatment for easy adhesion such as rendering the surface hydrophilic by corona discharge or the like or coating the surface of the support with the same water-soluble polymers as those used as the binders.

The layer construction of the reversible heat sensitive recording material of the present invention may comprise only the reversible heat sensitive recording layer. If necessary, a protective layer may be provided on the reversible heat sensitive recording layer or an interlayer containing at least one of water-soluble polymer, white or colored dye or pigment and hollow particles may be provided between the reversible heat sensitive recording layer and the support. In this case, the protective layer and/or interlayer may comprise a plurality of layers, namely, two layers or three or more layers, respectively. The reversible heat sensitive recording layer may also comprise two or more layers in which each component is contained in each one of the layers or the proportion of the components differs in the respective layers. Furthermore, materials in which the information can be electrically, optically or magnetically recorded may be contained in the reversible heat sensitive recording layer and/or other layers and/or the side of the support opposite to the side on which the reversible heat sensitive recording layer is provided. Moreover, for prevention of blocking or curling or for antistatic purpose, a backcoat layer may be provided on the side of the support opposite to the side on which the reversible heat sensitive recording layer is provided.

The method for forming the reversible heat sensitive recording material of the present invention by laminating the respective layers is unlimited and it can be formed by conventional methods. There may be used, for example, coating devices such as air knife coater, blade coater, bar coater and curtain coater and various printing devices of such types as lithographic printing, letterpress printing, intaglio printing, flexographic printing, gravure printing, screen printing and hot-melt printing. The layers can be held by UV irradiation and EB irradiation in addition to the usual drying step.

The reversible heat sensitive recording layer can be obtained by a method of mixing the dispersions obtained by finely grinding the respective components, coating the mixture on the support and drying the coat, a method of mixing the solutions obtained by dissolving the respective components in solvents, coating the mixture on the support and drying the coat, and other methods. The drying condition differs also depending on the dispersing media and the solvents such as water. In addition, there is a method of mixing the respective components, heating the mixture to melt the meltable component and coating it with heating.

Furthermore, the reversible heat sensitive recording layer and/or protective layer and/or interlayer may contain pigments such as diatomaceous earth, talc, kaolin, calcined kaolin, calcium carbonate, magnesium carbonate, titanium oxide, zinc oxide, silicon oxide, aluminum hydroxide and urea-formaldehyde resin, and, additionally, metal salts of higher fatty acids such as zinc stearate and calcium stearate and waxes such as paraffin, paraffin oxide, polyethylene, polyethylene oxide, stearic acid amide and castor wax for the prevention of sticking and wear of head, furthermore, dispersants such as sodium dioctylsulfosucccinate, surface active agents and fluorescent brighteners.

The method of color formation and color erasion of the reversible heat sensitive recording material of the present invention will be explained. For color formation, it suffices that a rapid cooling occurs subsequent to the heating, and the color formation can be carried out, for example, by thermal head, laser beam or the like. When the recording material is slowly cooled after heating, the color erasion occurs and this can be carried out, for example, by thermal head, hot roll, hot stamp, high-frequency heating, hot air, electric heater and radiation heat from light sources such as tungsten lamp and halogen lamp.

The principle of color formation and color erasion of the heat sensitive recording material of the present invention is not clear, but can be considered as follows. When the normally colorless or light colored dye precursor is heated together with an electron accepting compound such as a phenolic compound, electron transfer from the dye precursor to the electron accepting compound occurs to cause color formation. At this time, the molecule of the electron accepting compound is considered to be present very close to the molecule of the dye. Furthermore, when the molecule of the electron accepting compound is separated from the molecule of the dye which has formed color, the molecule of the dye which has formed color again accepts the electron to return to the original state of the dye precursor before the formation of color. It is considered that the present invention changes the distance between the molecule of the electron accepting compound and the molecule of the dye by heating to perform color formation and color erasion.

In more detail, it is considered that since many of electron accepting compounds which have hitherto been called reversible color developers have an aliphatic chain in the structure, they are poor in compatibility with the molecule of the dye precursor and the molecule of the dye which has formed color, and the former and the latter hardly melt together in solidified state. In such a state as the heat molten state where the molecule of the dye precursor and the molecule of the reversible color developer can move freely, the molecule of the dye precursor and the molecule of the reversible color developer melt together at a certain ratio, resulting in color formed state. Therefore, when the mixture in the molten state which forms color is slowly cooled, the molecule of the reversible color developer and the molecule of the dye become unmeltable together as the temperature decreases to cause phase separation, resulting in color erasion. It is considered that especially, the electron accepting compound represented by the formula 12 which is used preferably in the present invention contains a bond having hydrogen bonding ability such as amide bond in the molecule and, therefore, is rapidly crystallized due to the intermolecular hydrogen bond. On the other hand, when the mixture is rapidly cooled, it solidifes before the occurrence of phase separation, namely, in the color formed state. Therefore, the color formed state is fixed and is stably maintained even after the solidification.

It is considered that in the case of the color erasion accelerating compounds represented by the formulas (1)–(5) having both the aliphatic chain and the bond having the hydrogen bonding ability such as amide bond in the molecule like the reversible color developer explained above, the color formed state is broken by heating and they act as nuclei for crystallization when the reversible color developer separates from the dye. On the other hand, it is considered that it is widely known that in the heat sensitive recording materials which use an electron donating dye precursor, the printed image erases upon contact with basic compounds such as amines, and the color erasion accelerators used in the present invention which have a nitrogen-containing heterocyclic ring in the molecule which exhibits color erasion action further accelerate the color erasion phenomenon at the time of phase separation between the electron donating dye precursor and the electron accepting reversible color developer after decreasing of the temperature.

A part of specific processes for preparing the color erasion accelerators represented by the general formulas (1), (2), (3), (4) and (5) are illustrated below. However, the present invention is not limited thereto.

SYNTHESIS EXAMPLE 1

Synthesis of [2-(1-pyrrolidinyl)ethyl]N-octadecylcarbamate 10.1 Grams of N-hydroxyethylpyrrolidine, 23.6 g of octadecyl isocyanate and 100 ml of acetone were charged in a flask equipped with a stirrer and a condenser and refluxed with heating for 3 hours under stirring. The reaction mixture was cooled to room temperature, and the precipitated crystal was filtered off under reduced pressure and washed with acetone, followed by recrystallization from n-hexane to obtained 18.5 g of the desired product. m.p. 57° C.

SYNTHESIS EXAMPLE 2

Synthesis of hexadecyl N-(2-piperidinoethyl) carbamate 7.3 Grams of N-(2-aminoethyl)piperidine, 5.2 g of triethylamine and 100 ml of chloroform were charged in a flask equipped with a stirrer, a condenser and a calcium chloride drying tube and stirred with ice cooling. To the resulting solution was slowly added dropwise 15.8 g of hexadecyl chloroformate. After completion of the addition, the temperature of the solution was returned to room temperature, followed by refluxing with heating for 0.5 hour. The reaction mixture was cooled to room temperature, washed with water, dried over anhydrous magnesium sulfate and, then, concentrated under reduced pressure. The residue was recrystallized from methanol to obtain 16.3 g of the desired product. m.p. 48° C.

SYNTHESIS EXAMPLE 3

Synthesis of hexadecyl N-(2-morpholinoethyl) carbamate 8.6 Grams of N-(2-aminoethyl)morpholine, 7.2 g of triethylamine and 120 ml of chloroform were charged in a flask equipped with a stirrer, a condenser and a calcium chloride drying tube and stirred with ice cooling. To the resulting solution was slowly added dropwise 18.2 g of hexadecyl chloroformate. After completion of the addition, the temperature of the solution was returned to room temperature, followed by refluxing with heating for 0.5 hour. The reaction mixture was cooled to room temperature, washed with water, dried over anhydrous magnesium sulfate and, then, concentrated under reduced pressure. The residue was recrystallized from acetonitrile to obtain 21.1 g of the desired product. m.p. 65° C.

Synthesis Example 4

Synthesis of N-(3-morpholinopropiono)-N'-octadecanohydrazide 9.0 Grams of N-(3-morpholinopropiono)hydrazide, 5.3 g of triethylamine and 60 ml of chloroform were charged in a flask equipped with a stirrer, a condenser and a calcium chloride drying tube and stirred with heating at 40° C. in a nitrogen atmosphere. To the resulting solution was slowly added dropwise 14.3 g of octadecanoyl chloride. After completion of the addition, the stirring with heating was continued for 2 hours. The reaction mixture was cooled to room temperature to precipitate a white crystal. The precipitated crystal was filtered off under reduced pressure, washed with distilled water and recrystallized from 2-propanol to obtain 19.0 g of the desired product. m.p. 129° C.

SYNTHESIS EXAMPLE 5

Synthesis of hexadecyl N-(4-methylpiperadinyl) carbamate 6.3 Grams of N-amino-4-methylpiperadine, 6.0 g of triethylamine and 120 ml of chloroform were charged in a flask equipped with a stirrer, a condenser and a calcium chloride drying tube and stirred with ice cooling. To the solution was slowly added dropwise 15.2 g of hexadecyl chloroformate. After completion of the addition, the temperature of the solution was returned to room temperature, followed by refluxing with heating for 0.5 hour. The reaction mixture was cooled to room temperature, washed with water, dried over anhydrous magnesium sulfate and, then, concentrated under reduced pressure. The residue was recrystallized from acetonitrile to obtain 16.8 g of the desired product. m.p. 92° C.

SYNTHESIS EXAMPLE 6

Synthesis of N-(3-diethylaminopropyl)-11-decylthioundecanamide

132 Grams of 11-bromoundecanoic acid, 91.5 g of decanethiol, 59.4 g of sodium methoxide (28% methanolic solution) and 1.5 liter of methanol were charged in a flask equipped with a stirrer and a condenser and refluxed with heating for 24 hours under stirring. The reaction mixture was cooled to room temperature, and the precipitated crystal was filtered off under reduced pressure and washed with methanol. The resulting crystal was suspended in 5 liters of pure water and neutralized with concentrated hydrochloric acid. The crystal was again filtered off under reduced pressure, sufficiently washed with water until the wash liquid became neutral and recrystallized from ethanol to obtain 140.5 g of the desired product. Then, 14.3 g of the resulting carboxylic acid, 5.7 g of thionyl chloride, a drop of N,N-dimethylformamide (DMF) and 40 ml of chloroform were charged in a flask equipped with a stirrer and a condenser, and refluxed with heating for 2 hours under stirring. After completion of the reaction, chloroform and excess thionyl chloride were distilled off under reduced pressure to obtain a colorless and transparent oily product. Benzene (10 ml) was added to the oily product to dissolve it, followed by again distilling off under reduced pressure. 7.5 Grams of the resulting acid chloride was added dropwise to 30 ml of a solution prepared by dissolving 2.6 g of N,N-diethylamino-1,3-diaminopropane in N,N-dimethylacetamide which was previously charged in a flask, followed by stirring for 2 hours in an atmosphere of room temperature. After completion of the reaction, the reaction mixture was diluted with 300 ml of benzene, and washed with 5% aqueous sodium bicarbonate solution, pure water and saturated aqueous sodium chloride solution in succession. The organic layer was dried over anhydrous magnesium sulfate and the solvent was distilled off under reduced pressure to obtain a crystal. The crystal was recrystallized from n-hexane to obtain 6.9 g of the desired product. m.p. 61° C.

SYNTHESIS EXAMPLE 7

Synthesis of N-(2-morpholinoethyl)-11-decylthioundecanamide 2.6 Grams of N-(2-aminoethyl)morpholine and 30 ml of N,N-dimethylacetamide were charged in a flask equipped with a stirrer, a condenser and a calcium chloride drying tube and stirred with ice cooling. To the resulting solution was slowly added dropwise 7.5 g of 11-decylthioundecanoic acid chloride. After completion of the addition, the temperature of the solution was returned to room temperature, followed by further stirring for 2 hours. The reaction mixture was diluted with 300 ml of benzene, and washed with 5% aqueous sodium bicarbonate solution, pure water and saturated aqueous sodium chloride solution in succession. The organic layer was dried over anhydrous magnesium sulfate and the solvent was distilled off under reduced pressure to obtain a crystal. The crystal was recrystallized from n-hexane to obtain 7.3 g of the desired product. m.p. 80° C.

SYNTHESIS EXAMPLE 8

Synthesis of 2-morpholinoethyl N-10-decylthiodecylcarbamate 7.5 Grams of 11-decylthioundecanoic acid chloride and 20 ml of acetone were charged in a flask equipped with a stirrer and a condenser and stirred with ice cooling. To the resulting solution was slowly added dropwise 5 ml of an aqueous solution containing 2.0 g of sodium azide. After completion of the addition, the solution was further stirred for 1 hour at the same temperature. The reaction mixture was diluted with 300 ml of benzene, and washed with pure water and saturated aqueous sodium chloride solution in succession. The organic layer was dried over anhydrous sodium sulfate and, then, filtrate was refluxed with heating for 1 hour. To the reaction mixture was added 2.6 g of N-β-hydroxyethylmorpholine, followed by refluxing with heating for 3 hours. After completion of the reaction, the solvent was distilled off under reduced pressure and the residue was recrystallized from n-hexane to obtain 5.9 g of the desired product. m.p. 91° C.

SYNTHESIS EXAMPLE 9

Synthesis of N-(3-morpholinopropyl)-3-dodecylthiopropanamide 8.23 Grams of 3-dodecylthiopropionic acid, 4.6 g of oxalyl chloride and 50 ml of benzene were charged in a flask equipped with a stirrer, a condenser and a calcium chloride drying tube and stirred for 24 hours at room temperature. After completion of the reaction, excess oxalyl chloride and benzene were distilled off under reduced pressure to prepare an acid chloride. The total of the resulting acid chloride was slowly added dropwise to 5.2 g of separately prepared N-(3-aminopropyl)morpholine, 3.7 g of triethylamine and 60 ml of N,N-dimethylacetamide which were charged in a flask. After completion of the addition, the mixture was stirred at room temperature for 2 hours. After completion of the reaction, the reaction mixture was introduced into 300 ml of pure water and extracted with chloroform. The chloroform layer was washed with saturated aqueous sodium chloride solution, and, then, chloroform was distilled off under reduced pressure and the residue was recrystallized from methanol to obtain 6.5 g of the desired product. m.p. 46° C.

SYNTHESIS EXAMPLE 10

Synthesis of N-[3-(diethoxyphosphoryl)propiono]-N'-octadecanohydrazide 10.0 Grams of N-[3-(diethoxyphosphoryl)propiono] hydrazide, 5.4 g of triethylamine and 100 ml of dimethylacetamide were charged in a flask equipped with a stirrer and a condenser and stirred with cooling by water bath. To the resulting solution was slowly added dropwise 13.5 g of octadecanoic acid chloride, followed by continuing the stirring for 1 hour. Then, the solution was heated to 50° C. by a water bath for 1 hour with stirring. The reaction mixture was cooled to room temperature and the precipitated crystal was filtered off under reduced pressure, washed with distilled water and recrystallized from 2-methoxy ethanol to obtain 8.5 g of the desired product as a white crystal. m.p. 85° C.

SYNTHESIS EXAMPLE 11

Synthesis of N-[3-(methylsulfinyl)propyl]-N'-octadecylurea 10.6 Grams of 3-(methylsulfinyl)propylamine hydrobromide, 5.6 g of triethylamine and 100 ml of acetone were charged in a flask equipped with a stirrer, a condenser and a calcium chloride drying tube and stirred at room temperature. To the resulting solution was slowly added dropwise 14.8 g of octadecyl isocyanate. After completion of the addition, the temperature of the solution was returned to room temperature, followed by refluxing with heating for 2 hours. The reaction mixture was cooled to room temperature, and the precipitated crystal was filtered off under reduced pressure and washed with distilled water. The crystal was recrystallized from 2-propanol to obtain 14.9 g of the desired product. m.p. 105° C.

SYNTHESIS EXAMPLE 12

Synthesis of N-[3-(methylsulfinyl)propionyl]N'-octadecanohydrazide 7.5 Grams of 3-(methylsulfinyl)propionyl -hydrazide, 6.1 g of triethylamine and 100 ml of N,N-dimethylacetamide were charged in a flask equipped with a stirrer, a condenser and a calcium chloride drying tube and stirred with ice cooling. To the resulting solution was slowly added dropwise 15.1 g of octadecanoic acid chloride. After completion of the addition, the temperature of the solution was returned to room temperature, followed by stirring with heating at 60° C. by a water bath for 2 hours. The reaction mixture was cooled to room temperature, and the precipitated crystal was filtered off under reduced pressure and washed with distilled water. The crystal was recrystallized from 2-propanol to obtain 13.6 g of the desired product. m.p. 144° C.

SYNTHESIS EXAMPLE 13

Synthesis of N-octadecylsuccinimide 30.6 Grams of bromooctadecane, 10.0 g of succinimide, 13.9 g of potassium carbonate, 0.5 g of potassium iodide and 60 ml of N,N-dimethylformamide (DMF) were charged in a flask equipped with a stirrer and a condenser and stirred with heating on an oil bath of 100° C. for 2 hours. The reaction mixture was cooled to room temperature and introduced into a large amount of pure water. The precipitated crystal was filtered off under reduced pressure and washed with methanol. The crystal was recrystallized from 2-propanol to obtain 28.5 g of the desired product. m.p. 75.8° C.

SYNTHESIS EXAMPLE 14

Synthesis of N-(10-dodecylthio)decylsuccinimide 26.6 Grams of 11-bromoundecanoic acid, 21.2 g of dodecyl mercaptan, 42.4 ml of sodium methoxide (28% methanolic solution) and 300 ml of methanol were charged in a flask equipped with a stirrer, a condenser and a calcium chloride drying tube, and refluxed with heating for 6 hours on an oil bath. The reaction mixture was cooled to room temperature, and the precipitated crystal was filtered off under reduced pressure and washed with methanol. The resulting crystal was suspended in 1000 ml of pure water and adjusted to pH 2 with addition of concentrated hydrochloric acid, followed by stirring with heating on a water bath of 60° C. for 20 minutes. After neutralization, the crystal was filtered off under reduced pressure and washed with pure water. The crystal was recrystallized from ethanol to obtain 35.2 g of 11-dodecylthioundecanoic acid. Then, 27.0 g of the resulting carboxylic acid, 10.0 g of thionyl chloride, a drop of DMF and 100 ml of chloroform were charged in a flask, and refluxed with heating for 2 hours on an oil bath. After completion of the reaction, chloroform and excess thionyl chloride were distilled off under reduced pressure to obtain an acid chloride. The whole of the resulting acid chloride was diluted with 100 ml of acetone and this was added dropwise to a previously prepared aqueous solution of 5.9 g of sodium azide in 60 ml of pure water under cooling with ice water. After completion of the addition, the solution was stirred at the same temperature for 1 hour and the reaction mixture was extracted twice with 300 ml of benzene. The benzene layers were combined and washed thrice with pure water and once with a saturated aqueous sodium chloride solution. The benzene layer was dried over anhydrous sodium sulfate and the filtrate was refluxed with heating for 1 hour. To this reaction mixture were added 11.3 g of benzyl alcohol and three drops of triethylamine, followed by refluxing with heating for 2 hours. After completion of the reaction, benzene was distilled off under reduced pressure and the residual crystal was recrystallized from ethanol to obtain 26.5 g of benzyl N-(10-dodecylthio)decylcarbamate. 24.5 Grams of the resulting N-Cbz compound, 20 ml of 48% hydrobromic acid and 180 ml of glacial acetic acid were charged in a flask and refluxed with heating for 2 hours. After completion of the reaction, glacial acetic acid was distilled off under reduced pressure and the residual crystal was recrystallized from ethanol to obtain 17.0 g of HBr salt of 10-dodecylthiodecylamine. 4.4 Grams of the resulting HBr salt of amine, 1.1 g of succinic anhydride, 1.0 g of triethylamine and 50 ml of 1,4-dioxane were charged in a flask and stirred at 50° C. on a water bath for 1.5 hours. To the resulting reaction mixture were added 1.5 g of acetic anhydride and 0.4 g of sodium acetate, followed by refluxing with heating for 3 hours. After completion of the reaction, 1,4-dioxane was distilled off under reduced pressure, and the residue was introduced into ice-dilute hydrochloric acid and the crystal was filtered off under reduced pressure. The resulting crystal was washed with water and recrystallized from a mixed solvent of methanol and 2-propanol to obtain 3.0 g of the desired product. m.p. 85.9° C.

SYNTHESIS EXAMPLE 15

Synthesis of docosanohydrazide 17.0 Grams of docosanoic acid, 1.0 g of p-toluenesulfonic acid monohydrate and 200 ml of n-propanol were charged in a flask equipped with a stirrer, a condenser and a calcium chloride drying tube and refluxed with heating for 4 hours. To the resulting solution was added 12.5 g of hydrazine monohydrate, followed by continuing the refluxing with heating for 20 hours. The reaction mixture was cooled to room temperature and the precipitated crystal was filtered off under reduced pressure and washed with distilled water. The crystal was recrystallized from 2-propanol to obtain 14.2 g of the desired product. m.p. 117° C.

SYNTHESIS EXAMPLE 16

Synthesis of N-octadecyloxamide 13.5 Grams of octadecylamine, 6.4 g of ethyl oxamate and 200 ml of ethanol were charged in a flask equipped with a stirrer, a condenser and a calcium chloride drying tube and refluxed with heating for 1 hour. The reaction mixture was cooled to room temperature and the precipitated crystal was filtered off under reduced pressure and was recrystallized from ethanol to obtain 12.8 g of the desired product. m.p. 169° C.

SYNTHESIS EXAMPLE 17

Synthesis of 4-octadecylsemicarbazide 20.0 Grams of hydrazine monohydrate and 200 ml of ethanol were charged in a flask equipped with a stirrer, a condenser and a calcium chloride drying tube and stirred with ice cooling. To the resulting solution was slowly added dropwise 14.8 g of octadecyl isocyanate. After completion of the addition, the temperature was returned to room temperature, followed by stirring for 1 hour, and the precipitated crystal was filtered off under reduced pressure and was recrystallized from ethanol to obtain 8.2 g of the desired product. m.p. 100° C.

SYNTHESIS EXAMPLE 18

Synthesis of 6-(octadecylthio)hexanamide 19.3 Grams of ammonium acetate and 100 ml of N,N-dimethylacetamide were charged in a flask equipped with a stirrer, a condenser and a calcium chloride drying tube and stirred at room temperature. Thereto was slowly added dropwise 21.0 g of 6-(octadecylthio) hexanoic acid chloride, followed by continuing the stirring for 20 hours and, then, stirring with heating at 60° C. by a water bath for 2 hours. The reaction mixture was cooled to room temperature and the precipitated crystal was filtered off under reduced pressure and washed with acetone. The precipitated crystal was filtered off under reduced pressure and washed with distilled water. The crystal was recrystallized from 2-propanol to obtain 16.0 g of the desired product as a white crystal. m.p. 105° C.

SYNTHESIS EXAMPLE 19

Synthesis of 11-(octadecylthio)undecanamide 13.2 Grams of octadecanethiol, 14.3 g of 11-bromoundecanamide, 1.7 g of potassium iodide, 20.7 g of potassium carbonate and 100 ml of N,N-dimethylacetamide were charged in a flask equipped with a stirrer, a condenser and a calcium chloride drying tube and stirred with heating at 100° C. for 5 hours. The reaction mixture was cooled to room temperature and, then, introduced into ice water, and the precipitated crystal was filtered off under reduced pressure and washed with distilled water. The crystal was recrystallized from 2-propanol to obtain 16.4 g of the desired product. m.p. 108° C.

SYNTHESIS EXAMPLE 20

Synthesis of 11-(hexadecylthio)undecanohydrazide 22.1 Grams of 11-(hexadecylthio)undecanoic acid, 1.0 g of p-toluenesulfonic acid monohydrate and 200 ml of n-propanol were charged in a flask equipped with a stirrer, a condenser and a calcium chloride drying tube and refluxed with heating for 4 hours. Thereafter, to the solution was added 12.5 g of hydrazine monohydrate, followed by refluxing with heating for further 20 hours. The reaction mixture was cooled to room temperature and the precipitated crystal was filtered off under reduced pressure and washed with distilled water. The crystal was recrystallized from 2-propanol to obtain 16.0 g of the desired product. m.p. 108° C.

Next, specific synthesis examples of the reversible color developers represented by the general formula (6) are illustrated below. However, the processes for producing the compounds of the present invention are not limited thereto.

SYNTHESIS EXAMPLE 21

Synthesis of 3-(docosylthio)propionohydrazide 22.1 Grams of ethyl 3-(docosylthio)propionate, 150 ml of n-propanol and 12.5 g of hydrazine monohydrate were charged in a flask equipped with a stirrer, a condenser and a calcium chloride drying tube and refluxed with heating for 20 hours. The reaction mixture was cooled to room temperature and the precipitated crystal was filtered off under reduced pressure and washed with distilled water. The crystal was recrystallized from 2-propanol to obtain 17.2 g of the desired product. m.p. 106° C.

SYNTHESIS EXAMPLE 22

Synthesis of n-octadecylsuccinic acid [N-(4-hydroxyphenyl)]imide 3.7 Grams of 4-aminophenol and 80 ml of ethyl methyl ketone were charged in a 300 ml flask equipped with a stirrer and a condenser and stirred in an atmosphere of room temperature. Thereto was added 12.0 g of powdery n-octadecylsuccinic anhydride little by little in several parts, followed by stirring at 70°–75° C. for 1 hour. Then, 120 ml of diglyme was added thereto, followed by heating with gently passing N2 gas to first distill off ethyl methyl ketone and then slowly distill off diglyme. After distilling off most of diglyme (the time required: about 3 hours), 120 ml of toluene was added to the residue, followed by leaving to cool. The precipitated crystal was filtered off and washed. The crystal was recrystallized from n-propanol to obtain 10.6 g of the desired product. m.p. 133°–134° C.

SYNTHESIS EXAMPLE 23

Synthesis of (n-octadecylthio)succinic acid [N-(4-hydroxyphenyl)limide 11.5 Grams of n-octadecyl mercaptan, 0.2 g of triethylamine and 60 ml of 1,4-dioxane were charged in a 300 ml flask equipped with a stirrer and a condenser and stirred in a water bath of 40°–45° C. Thereto was added dropwise 75 ml of a solution of 9.2 g of N-(4-acetoxyphenyl)maleimide in 1,4-dioxane over a period of about 25 minutes. After completion of the addition, stirring was carried out further for 30 minutes. Then, thereto was added dropwise a solution prepared by adding 4.2 g of a 40% aqueous NaOH solution to 30 ml of methanol in an atmosphere of room temperature over a period of about 25 minutes, followed by stirring for 30 minutes. The reaction mixture was neutralized with acetic acid and, then, introduced into water. The precipitate was filtered off and washed with warm water and hydrated methanol in succession. The precipitate was recrystallized from 2-propanol to obtain 11.5 g of the desired product. m.p. 140.5°–142° C.

The present invention will be explained in more detail by the following examples. All parts and % in the examples are by weight.

Examples where color erasion accelerators represented by the formula (1) were used.

EXAMPLE 1

(A) Preparation of reversible heat sensitive coating liquid:

40 Parts of 3-diethylamino-6-methyl-7-anilinofluoran was ground together with 90 parts of a 2.5% aqueous polyvinyl alcohol solution by a paint conditioner to obtain a dye precursor dispersion (liquid A). Then, 100 parts of N-(4-hydroxyphenyl)-N'-octadecylurea was ground together with 400 parts of a 1.25% aqueous polyvinyl alcohol solution by a paint conditioner to obtain a reversible color developer dispersion (liquid B). Furthermore, 20 parts of magnesium carbonate was similarly ground together with 47 parts of a 0.2% aqueous polyvinyl alcohol solution (liquid C). Moreover, 10 parts of (2-(1-pyrrolidinyl)ethyl]N-octadecylcarbamate was ground together with 40 parts of a 1.25% aqueous polyvinyl alcohol solution by a paint conditioner to obtain a color erasion accelerator dispersion (liquid D). These four dispersions A, B, C and D were mixed, and 170 parts of a 10% aqueous polyvinyl alcohol solution and 350 parts of water were added to the resulting mixture, followed by well mixing them to obtain a reversible heat sensitive coating liquid.

(B) Preparation of reversible heat sensitive recording material:

The reversible heat sensitive coating liquid prepared in the above (A) was coated on a polyethylene terephthalate (PET) sheet at a solid coating amount of 2.6 g/m$^2$, and dried. Thereon was coated a 5% aqueous polyvinyl alcohol solution at a solid coating amount of 2 g/m$^2$, and dried, and then the coat was supercalendered to obtain a reversible heat sensitive recording material.

EXAMPLE 2

A reversible heat sensitive recording material was obtained in the same manner as in Example 1, except that hexadecyl N-(2-piperidinoethyl)carbamate was used in place of [2-(1-pyrrolidinyl)ethyl]N-octadecylcarbamate.

EXAMPLE 3

A reversible heat sensitive recording material was obtained in the same manner as in Example 1, except that hexadecyl N-(2-morpholinoethyl)carbamate was used in place of [2-(1-pyrrolidinyl)ethyl]N-octadecylcarbamate.

EXAMPLE 4

A reversible heat sensitive recording material was obtained in the same manner as in Example 1, except that N-(3-morpholinopropiono)-N'-octadecanohydrazide was used in place of [2-(1-pyrrolidinyl)ethyl]N-octadecylcarbamate.

EXAMPLE 5

A reversible heat sensitive recording material was obtained in the same manner as in Example 1, except that 1-(3-morpholinopropionyl)-4-octadecylsemicarbazide was used in place of [2-(1-pyrrolidinyl)ethyl]N-octadecylcarbamate.

EXAMPLE 6

A reversible heat sensitive recording material was obtained in the same manner as in Example 1, except that hexadecyl 3-(6-morpholinohexanoyl)carbazinate was used in place of [2-(1-pyrrolidinyl)ethyl]N-octadecylcarbamate.

EXAMPLE 7

A reversible heat sensitive recording material was obtained in the same manner as in Example 1, except that hexadecyl N-(4-methylpiperadinyl)carbamate was used in place of [2-(1-pyrrolidinyl)ethyl]N-octadecylcarbamate.

EXAMPLE 8

A reversible heat sensitive recording material was obtained in the same manner as in Example 1, except that N-(4-hydroxybenzo)-N'-octadecanohydrazide was used in place of N-(4-hydroxyphenyl)-N'-octadecylurea and N-(3-morpholinopropiono)-N'-octadecanohydrazide was used in place of [2-(1-pyrrolidinyl)ethyl]N-octadecylcarbamate.

EXAMPLE 9

A reversible heat sensitive recording material was obtained in the same manner as in Example 1, except that N-(4-hydroxyphenylthio)aceto-N'-docosanohydrazide was used in place of N-(4-hydroxyphenyl)-N'-octadecylurea and hexadecyl N-morpholinocarbamate was used in place of [2-(1-pyrrolidinyl)ethyl]N-octadecylcarbamate.

EXAMPLE 10

A reversible heat sensitive recording material was obtained in the same manner as in Example 1, except that 2-(4-octadecanoylaminophenyl)-4'-hydroxyacetanilide was used in place of N-(4-hydroxyphenyl)-N'-octadecylurea and 1-[3-(1-imidazolyl)propionylamino]-1-tetradecanoylaminomethane was used in place of [2-(1-pyrrolidinyl)ethyl]N-octadecylcarbamate.

EXAMPLE 11

A reversible heat sensitive recording material was obtained in the same manner as in Example 1, except that N-(3-diethylaminopropyl)-11-decylthioundecanamide was used in place of [2-(1-pyrrolidinyl)ethyl]N-octadecylcarbamate.

EXAMPLE 12

A reversible heat sensitive recording material was obtained in the same manner as in Example 11, except that 6-diethylaminohexyl N-(2-octadecylthioethyl) carbamate was used in place of N-(3-diethylaminopropyl)-11-decylthioundecanamide.

EXAMPLE 13

A reversible heat sensitive recording material was obtained in the same manner as in Example 11, except that N-4-aminocyclohexyl-N'-10-decylthiodecyloxamide was used in place of N-(3-diethylaminopropyl)-11-decylthioundecanamide.

EXAMPLE 14

A reversible heat sensitive recording material was obtained in the same manner as in Example 11, except that 2-(1-pyrrolidinyl)ethyl N-(2-dodecylthio)ethylcarbamate was used in place of N-(3-diethylaminopropyl)-11-decylthioundecanamide.

EXAMPLE 15

A reversible heat sensitive recording material was obtained in the same manner as in Example 11, except that N-[2-(1-piperidino)ethyl]-11-cyclohexylthioundecanamide was used in place of N-(3-diethylaminopropyl)-11-decylthioundecanamide.

EXAMPLE 16

A reversible heat sensitive recording material was obtained in the same manner as in Example 11, except that 1-[4-(1-methyl)piperidinylcarbo]-4-(10-dodecylthiodecyl) semicarbazide was used in place of N-(3-diethylaminopropyl)-11-decylthioundecanamide.

EXAMPLE 17

A reversible heat sensitive recording material was obtained in the same manner as in Example 11, except that N-(2-morpholinoethyl)-11-decylthioundecanamide was used in place of N-(3-diethylaminopropyl)-11-decylthioundecanamide.

EXAMPLE 18

A reversible heat sensitive recording material was obtained in the same manner as in Example 11, except that N-(4-hydroxybenzo)-N'-octadecanohydrazide was used in place of N-(4-hydroxyphenyl)-N'-octadecylurea and 2-morpholinoethyl N-l0-decylthiodecylcarbamate was used in place of N-(3-diethylaminopropyl)-11-decylthioundecanamide.

EXAMPLE 19

A reversible heat sensitive recording material was obtained in the same manner as in Example 11, except that N-(4-hydroxyphenylthio)aceto-N'-docosanohydrazide was used in place of N-(4-hydroxyphenyl)-N'-octadecylurea and N-3-morpholino-N'-10-decylthiodecyloxamide was used in place of N-(3-diethylaminopropyl)-11-decylthioundecanamide.

EXAMPLE 20

A reversible heat sensitive recording material was obtained in the same manner as in Example 11, except that 2-(4-octadecanoylaminophenyl)-4'-hydroxyacetanilide was used in place of N-(4-hydroxyphenyl)-N'-octadecylurea and N-(3-morpholinopropyl)-3-dodecylthiopropanamide was used in place of N-(3-diethylaminopropyl)-11-decylthioundecanamide.

COMPARATIVE EXAMPLE 1

A reversible heat sensitive recording material was obtained in the same manner as in Example 1, except that [2-(1-pyrrolidinyl)ethyl]N-octadecylcarbamate was not used.

COMPARATIVE EXAMPLE 2

A reversible heat sensitive recording material was obtained in the same manner as in Example 1, except that 2-benzyloxynaphthalene was used in place of [2-(1-pyrrolidinyl)ethyl]N-octadecylcarbamate.

COMPARATIVE EXAMPLE 3

A reversible heat sensitive recording material was obtained in the same manner as in Example 1, except that [2-(1-pyrrolidinyl)ethyl]N-octadecylcarbamate was not used and N-(4-hydroxybenzo)-N'-octadecanohydrazide was used in place of N-(4-hydroxyphenyl)-N'-octadecylurea.

COMPARATIVE EXAMPLE 4

A reversible heat sensitive recording material was obtained in the same manner as in Example 1, except that [2-(1-pyrrolidinyl)ethyl]N-octadecylcarbamate was not used and N-(4-hydroxyphenylthio)aceto-N'-docosanohydrazide was used in place of N-(4-hydroxyphenyl)-N'-octadecylurea.

COMPARATIVE EXAMPLE 5

A reversible heat sensitive recording material was obtained in the same manner as in Example 1, except that [2-(1-pyrrolidinyl)ethyl]N-octadecylcarbamate was not used and 2-(4-octadecanoylaminophenyl)-4'-hydroxyacetanilide was used in place of N-(4-hydroxyphenyl)-N'-octadecylurea.

COMPARATIVE EXAMPLE 6

A reversible heat sensitive recording material was obtained in the same manner as in Example 11, except that N-(3-diethylaminopropyl)-11-decylthioundecanamide was not used.

COMPARATIVE EXAMPLE 7

A reversible heat sensitive recording material was obtained in the same manner as in Example 11, except that 2-benzyloxynaphthalene was used in place of N-(3-diethylaminopropyl)-11-decylthioundecanamide.

COMPARATIVE EXAMPLE 8

A reversible heat sensitive recording material was obtained in the same manner as in Example 11, except that N-(3-diethylaminopropyl)-11-decylthioundecanamide was not used and N-(4-hydroxybenzo)-N'-octadecanohydrazide was used in place of N-(4-hydroxyphenyl)-N'-octadecylurea.

COMPARATIVE EXAMPLE 9

A reversible heat sensitive recording material was obtained in the same manner as in Example 11, except that N-(3-diethylaminopropyl)-11-decylthioundecanamide was not used and N-(4-hydroxyphenylthio)aceto-N'-docosanohydrazide was used in place of N-(4-hydroxyphenyl)-N'-octadecylurea.

COMPARATIVE EXAMPLE 10

A reversible heat sensitive recording material was obtained in the same manner as in Example 11, except that N-(3-diethylaminopropyl)-11-decylthioundecanamide was not used and 2-(4-octadecanoylaminophenyl)-4'-hydroxyacetoanilide was used in place of N-(4-hydroxyphenyl)-N'-octadecylurea.

Test 1 (Color density=thermal responsiveness)

The heat sensitive recording materials obtained in Examples 1–20 and Comparative Examples 1–10 were printed by a heat sensitive facsimile printing tester TH-PMD (manufactured by Ohkura Electric Co., Ltd.) provided with a printing head KJT-256-8MGF1 (manufactured by Kyocera Co., Ltd.) under the conditions of 1.1 msec in applied pulse and 26 volts in applied voltage. Density of the resulting color image was measured by a densitometer Macbeth RD918.

Test 2 (Erasability of image)

The heat sensitive recording materials obtained in Examples 1–20 and Comparative Examples 1–10 were printed by a heat sensitive facsimile printing tester TH-PMD (manufactured by Ohkura Electric Co., Ltd.) provided with a printing head KJT-256-8MGF1 (manufactured by Kyocera Co., Ltd.) under the conditions of 1.1 msec in applied pulse and 26 volts in applied voltage, and, then, these were heated at 100° C. for 1 second by a hot stamp, followed by measuring the density in the same manner as in the above Test 1.

Test 3 (Color erasion starting temperature)

The heat sensitive recording materials obtained in Examples 1–20 and Comparative Examples 1–10 were printed by a heat sensitive facsimile printing tester TH-PMD (manufactured by Ohkura Electric Co., Ltd.) provided with a printing head KJT-256-8MGF1 (manufactured by Kyocera Co., Ltd.) under the conditions of 1.1 msec in applied pulse and 26 volts in applied voltage, and, then, ten spots in total of the respective recording materials were heated, at intervals of 10° C., to 150° C. from 60° C. for 1 second for each spot by a hot stamp, followed by measuring the density in the same manner as in the Test 1. The heating temperature at which the optical density of the printed image decreased to lower than 0.15 was employed as a color erasion starting temperature.

Test 4 (Change of color density with time=image stability)

The heat sensitive recording materials obtained in Examples 1–20 and Comparative Examples 1–10 were printed by a heat sensitive facsimile printing tester TH-PMD (manufactured by Ohkura Electric Co., Ltd.) provided with a printing head KJT-256-8MGF1 (manufactured by Kyocera Co., Ltd.) under the conditions of 1.1 msec in applied pulse and 26 volts in applied voltage, and they were stored for 24 hours in an atmosphere of temperature: 35° C. and relative humidity: 20%, followed by measuring the density of the color formed portion in the same manner as in the above Test 1. The image retention rate was calculated by the following formula (8).

$$A=(C/B)\times 100 \quad (8)$$

A: Image retention rate (%)

B: Image density before subjecting to the test

C: Image density after subjecting to the test

The results of Tests 1–4 on the recording materials of Examples 1–10 and Comparative Examples 1–5 are shown in Table 1.

TABLE 1

| | (Test 1) Density of color formed portion | (Test 2) Density of erased portion | (Test 3) Color erasion starting temperature (°C.) | (Test 4) Image retention rate (%) |
|---|---|---|---|---|
| Example 1 | 1.23 | 0.08 | 80 | 65 |
| Example 2 | 1.22 | 0.08 | 90 | 62 |
| Example 3 | 1.15 | 0.05 | 80 | 61 |
| Example 4 | 1.21 | 0.09 | 80 | 87 |
| Example 5 | 1.22 | 0.09 | 80 | 82 |
| Example 6 | 1.20 | 0.06 | 80 | 72 |
| Example 7 | 1.24 | 0.06 | 70 | 65 |
| Example 8 | 1.11 | 0.06 | 80 | 95 |
| Example 9 | 1.20 | 0.08 | 80 | 90 |
| Example 10 | 1.28 | 0.08 | 80 | 98 |
| Comparative Example 1 | 1.23 | 0.24 | 120 | 65 |
| Comparative Example 2 | 1.10 | 0.19 | 110 | 17 |
| Comparative Example 3 | 1.10 | 0.21 | 110 | 96 |
| Comparative Example 4 | 1.20 | 0.29 | 120 | 99 |
| Comparative Example 5 | 1.22 | 0.20 | 110 | 99 |

The results of Tests 1–4 on the recording materials of Examples 11–20 and Comparative Examples 6–10 are shown in Table 2.

TABLE 2

| | (Test 1) Density of color formed portion | (Test 2) Density of erased portion | (Test 3) Color erasion starting temperature (°C.) | (Test 4) Image retention rate (%) |
|---|---|---|---|---|
| Example 11 | 1.13 | 0.07 | 80 | 65 |
| Example 12 | 1.22 | 0.07 | 90 | 60 |
| Example 13 | 1.25 | 0.06 | 90 | 61 |
| Example 14 | 1.18 | 0.06 | 80 | 60 |
| Example 15 | 1.25 | 0.07 | 80 | 62 |
| Example 16 | 1.23 | 0.06 | 80 | 65 |
| Example 17 | 1.22 | 0.06 | 70 | 62 |
| Example 18 | 1.19 | 0.05 | 80 | 90 |
| Example 19 | 1.24 | 0.07 | 90 | 95 |
| Example 20 | 1.22 | 0.07 | 90 | 97 |
| Comparative Example 6 | 1.26 | 0.26 | 120 | 66 |
| Comparative Example 7 | 1.08 | 0.17 | 110 | 16 |
| Comparative Example 8 | 1.10 | 0.21 | 110 | 96 |
| Comparative Example 9 | 1.21 | 0.29 | 120 | 99 |
| Comparative Example 10 | 1.22 | 0.20 | 110 | 99 |

Examples where the color erasion accelerators represented by the formula (2) were used:

EXAMPLE 21

A reversible heat sensitive recording material was obtained in the same manner as in Example 1, except that N-[3-(diethoxyphosphoryl)propiono]-N'-octadecanohydrazide was used in place of [2-(1-pyrrolidinyl)ethyl]N-octadecylcarbamate.

EXAMPLE 22

A reversible heat sensitive recording material was obtained in the same manner as in Example 21, except that N-[3-(diethoxyphosphoryl)propyl]-N'-octadecylurea was used in place of N-[3-(diethoxyphosphoryl)propiono]N'-octadecanohydrazide.

EXAMPLE 23

A reversible heat sensitive recording material was obtained in the same manner as in Example 21, except that N-(4-hydroxybenzo)-N'-octadecanohydrazide was used in place of N-(4-hydroxyphenyl)-N'-octadecylurea.

EXAMPLE 24

A reversible heat sensitive recording material was obtained in the same manner as in Example 21, except that N-(4-hydroxyphenylthio)aceto-N'-docosanohydrazide was used in place of N-(4-hydroxyphenyl)-N'-octadecylurea.

EXAMPLE 25

A reversible heat sensitive recording material was obtained in the same manner as in Example 21, except that 2-(4-octadecanoylaminophenyl)-4'-hydroxyacetanilide was used in place of N-(4-hydroxyphenyl)-N'-octadecylurea.

COMPARATIVE EXAMPLE 11

A reversible heat sensitive recording material was obtained in the same manner as in Example 21, except that N-[3-(diethoxyphosphoryl)propiono]-N'-octadecanohydrazide was not used.

COMPARATIVE EXAMPLE 12

A reversible heat sensitive recording material was obtained in the same manner as in Example 21, except that 2-benzyloxynaphthalene was used in place of N-[3-(diethoxyphosphoryl)propiono]-N'-octadecanohydrazide.

COMPARATIVE EXAMPLE 13

A reversible heat sensitive recording material was obtained in the same manner as in Example 21, except that N-[3-(diethoxyphosphoryl)propionol-N'-octadecanohydrazide was not used and N-(4-hydroxybenzo)-N'-octadecanohydrazide was used in place of N-(4-hydroxyphenyl)-N'-octadecylurea.

The results of Tests 1–4 on the recording materials of Examples 21–25 and Comparative Examples 11–13 are shown in Table 3.

TABLE 3

| | (Test 1) Density of color formed portion | (Test 2) Density of erased portion | (Test 3) Color erasion starting temperature (°C.) | (Test 4) Image retention rate (%) |
|---|---|---|---|---|
| Example 21 | 1.20 | 0.07 | 80 | 64 |
| Example 22 | 1.22 | 0.08 | 90 | 61 |
| Example 13 | 1.05 | 0.06 | 80 | 94 |
| Example 24 | 1.18 | 0.12 | 100 | 99 |
| Example 25 | 1.18 | 0.10 | 90 | 98 |
| Comparative Example 11 | 1.23 | 0.20 | 120 | 65 |
| Comparative Example 12 | 1.10 | 0.19 | 110 | 17 |
| Comparative Example 13 | 1.10 | 0.12 | 110 | 96 |

Examples where color erasion accelerators represented by the formula (3) were used.

EXAMPLE 26

A reversible heat sensitive recording material was obtained in the same manner as in Example 1, except that N-[3-(methylsulfinyl)propyl]-N'-octadecylurea was used in place of [2-(1-pyrrolidinyl)ethyll N-octadecylcarbamate.

EXAMPLE 27

A reversible heat sensitive recording material was obtained in the same manner as in Example 26, except that N-[3-(methylsulfinyl)propionyl]-N'-octadecanohydrazide was used in place of N-[3-(methylsulfinyl)propyl]-N'-octadecylurea.

EXAMPLE 28

A reversible heat sensitive recording material was obtained in the same manner as in Example 26, except that N-(4-hydroxybenzo)-N'-octadecanohydrazide was used in place of N-(4-hydroxyphenyl)-N'-octadecylurea.

COMPARATIVE EXAMPLE 14

A reversible heat sensitive recording material was obtained in the same manner as in Example 26, except that N-[3-(methylsulfinyl)propyl]-N'-octadecylurea was not used.

COMPARATIVE EXAMPLE 15

A reversible heat sensitive recording material was obtained in the same manner as in Example 26, except that 2-benzyloxynaphthalene was used in place of N-[3-(methylsulfinyl)propyl]-N'-octadecylurea.

The results of Test 1–4 on the recording materials of Examples 26–28 and Comparative Examples 14–15 are shown in Table 4.

TABLE 4

| | (Test 1) Density of color formed portion | (Test 2) Density of erased portion | (Test 3) Color erasion starting temperature (°C.) | (Test 4) Image retention rate (%) |
|---|---|---|---|---|
| Example 26 | 1.20 | 0.09 | 100 | 75 |
| Example 27 | 1.22 | 0.10 | 90 | 82 |
| Example 28 | 1.10 | 0.06 | 80 | 96 |
| Comparative Example 14 | 1.23 | 0.25 | 120 | 69 |
| Comparative Example 15 | 1.10 | 0.19 | 110 | 17 |

Examples where color erasion accelerators represented by the formula (4) were used.

EXAMPLE 29

A reversible heat sensitive recording material was obtained in the same manner as in Example 1, except that N-octadecylsuccinimide was used in place of [2-(1-pyrrolidinyl)ethyl]N-octadecylcarbamate.

EXAMPLE 30

A reversible heat sensitive recording material was obtained in the same manner as in Example 29, except that N-octadecylglutarimide was used in place of N-octadecylsuccinimide.

EXAMPLE 31

A reversible heat sensitive recording material was obtained in the same manner as in Example 29, except that N-(3-octadecylthio)propylsuccinimide was used in place of N-octadecylsuccinimide.

EXAMPLE 32

A reversible heat sensitive recording material was obtained in the same manner as in Example 29, except that N-(10-dodecylthio)decylsuccinimide was used in place of N-octadecylsuccinimide.

EXAMPLE 33

A reversible heat sensitive recording material was obtained in the same manner as in Example 29, except that N-(10-cyclohexylthio)decylsuccinimide was used in place of N-octadecylsuccinimide.

EXAMPLE 34

A reversible heat sensitive recording material was obtained in the same manner as in Example 29, except that N-(5-decylthio)pentylglutarimide was used in place of N-octadecylsuccinimide.

EXAMPLE 35

A reversible heat sensitive recording material was obtained in the same manner as in Example 29, except that N-(10-decylthio)decylglutarimide was used in place of N-octadecylsuccinimide.

EXAMPLE 36

A reversible heat sensitive recording material was obtained in the same manner as in Example 29, except that N-(4-hydroxybenzo)-N'-octadecanohydrazide was used in place of N-(4-hydroxyphenyl)-N'-octadecylurea.

EXAMPLE 37

A reversible heat sensitive recording material was obtained in the same manner as in Example 29, except that N-(4-hydroxyphenylthio)aceto-N'-docosanohydrazide was used in place of N-(4-hydroxyphenyl)-N'-octadecylurea and N-(10-dodecylthio)decylglutarimide was used in place of N-octadecylsuccinimide.

EXAMPLE 38

A reversible heat sensitive recording material was obtained in the same manner as in Example 29, except that 2-(4-octadecanoylaminophenyl)-4'-hydroxyacetanilide was used in place of N-(4-hydroxyphenyl)-N'-octadecylurea and N-(5-octadecylthio)pentylglutarimide was used in place of N-octadecylsuccinimide.

COMPARATIVE EXAMPLE 16

A reversible heat sensitive recording material was obtained in the same manner as in Example 29, except that N-octadecylsuccinimide was not used.

COMPARATIVE EXAMPLE 17

A reversible heat sensitive recording material was obtained in the same manner as in Example 29, except that 2-benzyloxynaphthalene was used in place of N-octadecylsuccinimide.

COMPARATIVE EXAMPLE 18

A reversible heat sensitive recording material was obtained in the same manner as in Example 29, except that N-octadecylsuccinimide was not used and N-(4-hydroxybenzo)-N'-octadecanohydrazide was used in place of N-(4-hydroxyphenyl)-N'-octadecylurea.

COMPARATIVE EXAMPLE 19

A reversible heat sensitive recording material was obtained in the same manner as in Example 29, except that N-octadecylsuccinimide was not used and N-(4-hydroxyphenylthio)aceto-N'-docosanohydrazide was used in place of N-(4-hydroxyphenyl)-N'-octadecylurea.

COMPARATIVE EXAMPLE 20

A reversible heat sensitive recording material was obtained in the same manner as in Example 29, except that N-octadecylsuccinimide was not used and 2-(4-octadecanoylaminophenyl)-4'-hydroxyacetanilide was used in place of N-(4-hydroxyphenyl)-N'-octadecylurea.

The results of Tests 1–4 on the recording materials of Examples 29–38 and Comparative Examples 16–20 are shown in Table 5.

TABLE 5

| | (Test 1) Density of color formed portion | (Test 2) Density of erased portion | (Test 3) Color erasion starting temperature (°C.) | (Test 4) Image retention rate (%) |
|---|---|---|---|---|
| Example 29 | 1.23 | 0.07 | 90 | 66 |
| Example 30 | 1.22 | 0.07 | 90 | 65 |
| Example 31 | 1.20 | 0.06 | 80 | 61 |
| Example 32 | 1.18 | 0.06 | 80 | 60 |
| Example 33 | 1.09 | 0.06 | 70 | 60 |
| Example 34 | 1.15 | 0.06 | 80 | 61 |
| Example 35 | 1.20 | 0.06 | 80 | 62 |
| Example 36 | 1.20 | 0.07 | 90 | 90 |
| Example 37 | 1.22 | 0.07 | 90 | 95 |
| Example 38 | 1.22 | 0.07 | 90 | 97 |
| Comparative Example 16 | 1.27 | 0.26 | 120 | 65 |
| Comparative Example 17 | 1.09 | 0.17 | 110 | 17 |
| Comparative Example 18 | 1.10 | 0.21 | 110 | 96 |
| Comparative Example 19 | 1.20 | 0.29 | 120 | 99 |
| Comparative Example 20 | 1.22 | 0.21 | 110 | 99 |

Examples where color erasion accelerators represented by the formula (5) were used.

EXAMPLE 39

A reversible heat sensitive recording material was obtained in the same manner as in Example 1, except that docosanohydrazide was used in place of [2-(1-pyrrolidinyl) ethyl]N-octadecylcarbamate.

EXAMPLE 40

A reversible heat sensitive recording material was obtained in the same manner as in Example 39, except that octadecyloxamide was used in place of docosanohydrazide.

EXAMPLE 41

A reversible heat sensitive recording material was obtained in the same manner as in Example 39, except that octadecylsemicarbazide was used in place of docosanohydrazide.

EXAMPLE 42

A reversible heat sensitive recording material was obtained in the same manner as in Example 39, except that 6-(octadecylthio)hexanamide was used in place of docosanohydrazide.

EXAMPLE 43

A reversible heat sensitive recording material was obtained in the same manner as in Example 39, except that 11-(octadecylthio)undecanamide was used in place of docosanohydrazide.

EXAMPLE 44

A reversible heat sensitive recording material was obtained in the same manner as in Example 39, except that 11-(hexadecylthio)undecanohydrazide was used in place of docosanohydrazide.

EXAMPLE 45

A reversible heat sensitive recording material was obtained in the same manner as in Example 39, except that 3-(docosylthio)propionohydrazide was used in place of docosanohydrazide.

EXAMPLE 46

A reversible heat sensitive recording material was obtained in the same manner as in Example 39, except that N-[11-(4-hydroxyphenylthio)undecano]-N'-decanohydrazide was used in place of N-(4-hydroxyphenyl)-N'-octadecylurea and octadecylurea was used in place of docosanohydrazide.

EXAMPLE 47

A reversible heat sensitive recording material was obtained in the same manner as in Example 39, except that N-[3-(4-hydroxyphenyl)propiono]-N'-docosanohydrazide was used in place of N-(4-hydroxyphenyl)-N'-octadecylurea and 11-(octadecylthio)undecanohydrazide was used in place of docosanohydrazide.

EXAMPLE 48

A reversible heat sensitive recording material was obtained in the same manner as in Example 39, except that 2-(4-octadecanoylaminophenyl)-4'-hydroxyacetanilide was used in place of N-(4-hydroxyphenyl)-N'-octadecylurea and p-(octadecylthio)benzamide was used in place of docosanohydrazide.

COMPARATIVE EXAMPLE 21

A reversible heat sensitive recording material was obtained in the same manner as in Example 39, except that docosanohydrazide was not used.

COMPARATIVE EXAMPLE 22

A reversible heat sensitive recording material was obtained in the same manner as in Example 39, except that stearic acid amide was used in place of docosanohydrazide.

COMPARATIVE EXAMPLE 23

A reversible heat sensitive recording material was obtained in the same manner as in Example 39, except that 2-benzyloxynaphthalene was used in place of docosanohydrazide.

COMPARATIVE EXAMPLE 24

A reversible heat sensitive recording material was obtained in the same manner as in Example 39, except that docosanohydrazide was not used and N-[11-(4-hydroxyphenylthio)undecano]-N'-decanohydrazide was used in place of N-(4-hydroxyphenyl)-N'-octadecylurea.

COMPARATIVE EXAMPLE 25

A reversible heat sensitive recording material was obtained in the same manner as in Example 39, except that docosanohydrazide was not used and N-[3-(4-hydroxyphenyl)propiono]-N'-docosanohydrazide was used in place of N-(4-hydroxyphenyl)-N'-octadecylurea.

COMPARATIVE EXAMPLE 26

A reversible heat sensitive recording material was obtained in the same manner as in Example 39, except that docosanohydrazide was not used and 2-(4-octadecanoylaminophenyl)-4'-hydroxyacetanilide was used in place of N-(4-hydroxyphenyl)-N'-octadecylurea.

The results of Test 1–4 on the recording materials of Examples 39–48 and Comparative Examples 21–26 are shown in Table 6.

TABLE 6

| | (Test 1) Density of color formed portion | (Test 2) Density of erased portion | (Test 3) Color erasion starting temperature (°C.) | (Test 4) Image retention rate (%) |
|---|---|---|---|---|
| Example 39 | 1.22 | 0.08 | 80 | 70 |
| Example 40 | 1.23 | 0.12 | 100 | 70 |
| Example 41 | 1.22 | 0.12 | 100 | 70 |
| Example 42 | 1.23 | 0.09 | 90 | 81 |
| Example 43 | 1.20 | 0.07 | 80 | 83 |
| Example 44 | 1.22 | 0.06 | 80 | 88 |
| Example 45 | 1.22 | 0.06 | 80 | 86 |
| Example 46 | 1.18 | 0.10 | 100 | 94 |
| Example 47 | 1.18 | 0.08 | 90 | 96 |
| Example 48 | 1.18 | 0.09 | 80 | 98 |
| Comparative Example 21 | 1.23 | 0.20 | 120 | 69 |
| Comparative Example 22 | 1.20 | 0.08 | 80 | 28 |
| Comparative Example 23 | 1.10 | 0.19 | 110 | 17 |
| Comparative Example 24 | 1.18 | 0.20 | 130 | 99 |
| Comparative Example 25 | 1.10 | 0.12 | 110 | 99 |
| Comparative Example 26 | 1.18 | 0.13 | 100 | 99 |

Examples where color erasion accelerators represented by the formula (1) or (4) and color developers represented by the formula (6) were used.

EXAMPLE 49

(A) Preparation of reversible heat sensitive coating liquid:

40 Parts of 3-di-n-butylamino-6-methyl-7-anilinofluoran as a dye precursor was ground together with 90 parts of a 2.5% aqueous polyvinyl alcohol solution for 18 hours by a paint conditioner to obtain a dye precursor dispersion (liquid A). Then, 100 parts of (n-octadecylthio)succinic acid [N-(4-hydroxyphenyl]imide was ground together with 400 parts of a 1.25% aqueous polyvinyl alcohol solution for 18 hours by a paint conditioner to obtain an electron accepting compound dispersion (liquid B). Furthermore, 20 parts of magnesium carbonate and 47 parts of a 0.2% aqueous polyvinyl alcohol solution were ground by a homogenizer to obtain a dispersion (liquid C). Moreover, 1.0 part of hexadecyl N-(3-morpholinopropyl)carbamate was ground together with 40 parts of a 1.25% aqueous polyvinyl alcohol solution for 18 hours by a paint conditioner to obtain a color erasion accelerator dispersion (liquid D). These four dispersions A, B, C and D were mixed, and 170 parts of a 10% aqueous polyvinyl alcohol solution and 350 parts of water were added to the resulting mixture, followed by well mixing them to obtain a reversible heat sensitive coating liquid.

The reversible heat sensitive coating liquid prepared in the above (A) was coated on a polyethylene terephthalate (PET) sheet at a solid coating amount of 4 g/m2, and dried, and then the coat was supercalendered to obtain a reversible heat sensitive recording material.

EXAMPLE 50

A reversible heat sensitive recording material was obtained in the same manner as in Example 49, except that hexadecyl N-(4-methylpiperadinyl)carbamate was used in place of hexadecyl N-(3-morpholinopropyl)carbamate.

EXAMPLE 51

A reversible heat sensitive recording material was obtained in the same manner as in Example 49, except that [2-(1-pyrrolidinyl)ethyl]N-octadecylcarbamate was used in place of hexadecyl N-(3-morpholinopropyl)carbamate.

EXAMPLE 52

A reversible heat sensitive recording material was obtained in the same manner as in Example 49, except that N-(2-morpholinoethyl)-11-decylthioundecanamide was used in place of hexadecyl N-(3-morpholinopropyl) carbamate.

EXAMPLE 53

A reversible heat sensitive recording material was obtained in the same manner as in Example 49, except that N-(3-diethylaminopropyl)-11-decylthioundecanamide was used in place of hexadecyl N-(3-morpholinopropyl) carbamate.

EXAMPLE 54

A reversible heat sensitive recording material was obtained in the same manner as in Example 49, except that N-(4-methylpiperadinyl)-3-dodecylthiopropanamide was used in place of hexadecyl N-(3-morpholinopropyl) carbamate.

EXAMPLE 55

A reversible heat sensitive recording material was obtained in the same manner as in Example 49, except that N-octadecylsuccinimide was used in place of hexadecyl N-(3-morpholinopropyl)carbamate.

EXAMPLE 56

A reversible heat sensitive recording material was obtained in the same manner as in Example 49, except that N-(2-octadecylthio)ethylsuccinimide was used in place of hexadecyl N-(3-morpholinopropyl)carbamate.

EXAMPLE 57

A reversible heat sensitive recording material was obtained in the same manner as in Example 49, except that [(n-octadecylthio)]methylsuccinic acid [N-(4-hydroxyphenyl)]imide was used in place of (n-octadecylthio)]succinic acid [N-(4-hydroxyphenyl)] imide.

EXAMPLE 58

A reversible heat sensitive recording material was obtained in the same manner as in Example 49, except that 3-diethylamino-6-methyl-7-anilinofluoran was used in place of 3-di-n-butylamino-6-methyl-7-anilinofluoran.

COMPARATIVE EXAMPLE 27

A reversible heat sensitive recording material was obtained in the same manner as in Example 49, except that hexadecyl N-(3-morpholinopropyl)carbamate was not used.

COMPARATIVE EXAMPLE 28

A reversible heat sensitive recording material was obtained in the same manner as in Example 49, except that stearic acid amide was used in place of hexadecyl N-(3-morpholinopropyl)carbamate.

COMPARATIVE EXAMPLE 29

A reversible heat sensitive recording material was obtained in the same manner as in Example 49, except that [(n-octadecylthio)]methylsuccinic acid [N-(4-hydroxyphenyl)]imide was used in place of (n-octadecylthio)]succinic acid [N-(4-hydroxyphenyl)] imide and hexadecyl N-(3-morpholinopropyl)carbamate was not used.

Test 5 (Image erasion speed at room temperature)

The heat sensitive recording materials obtained in Examples 49–58 and Comparative Examples 27–29 were printed by the method of Test 1. The resulting color formed image portion was left to stand at room temperature (23° C.) and change of density of the color formed image with time was measured at intervals of 1 hour in the same manner as in Test 1. The time when the optical density of the color formed image decreased to lower than 0.15 was measured.

Test 6 (Image erasability at room temperature)

The optical density of the color erased portion which was most highly erased in the Test 5 was measured in the same manner as in Test 1.

Test 7 (Image erasion speed at 35° C.)

The heat sensitive recording materials obtained in Examples 49–57 and Comparative Examples 27–29 were printed by the method of Test 1. The resulting color formed image portion was left to stand at 35° C. and change in density of the color formed image with time was measured at intervals of 10 minutes in the same manner as in Test 1. The time when the optical density of the color formed image decreased to lower than 0.15 was measured.

Test 8 (Image erasability at 35° C.)

The optical density of the color erased portion which was most highly erased in the Test 7 was measured in the same manner as in Test 1.

Test 9 (Image erasability by drier)

The printed image obtained in Test 1 was heated by a drier and the optical density of the color erased portion which was most highly erased was measured in the same manner as in Test 1.

The results of Test 1 and Tests 5–9 on the recording materials of Examples 49–58 and Comparative Examples 27–29 are shown in Table 7.

TABLE 7

| | Test 1 Density of color formed portion (O.D.) | Test 5 Erasion time at room temperature | Test 6 Density of erased portion at room temperature (O.D.) | Test 7 Erasion time at 35° C. | Test 8 Density of erased portion at 35° C. (O.D.) | Test 9 Density of portion erased by drier (O.D.) |
|---|---|---|---|---|---|---|
| Example 49 | 1.11 | 5 days | 0.05 | 30 min | 0.05 | 0.05 |
| Example 50 | 1.08 | 6 days | 0.06 | 40 min | 0.05 | 0.06 |
| Example 51 | 1.07 | 6 days | 0.06 | 40 min | 0.06 | 0.06 |

TABLE 7-continued

| | | | | | | |
|---|---|---|---|---|---|---|
| Example 52 | 1.14 | 4 days | 0.05 | 20 min | 0.05 | 0.05 |
| Example 53 | 1.12 | 7 days | 0.06 | 2 hr | 0.05 | 0.06 |
| Example 54 | 1.12 | 5 days | 0.05 | 40 min | 0.05 | 0.05 |
| Example 55 | 1.13 | 9 days | 0.11 | 3 hr | 0.07 | 0.07 |
| Example 56 | 1.10 | 10 days | 0.12 | 4 hr | 0.07 | 0.07 |
| Example 57 | 1.01 | 6 days | 0.08 | 40 min | 0.06 | 0.06 |
| Example 58 | 1.20 | 20 days | 0.09 | 2 days | 0.08 | 0.08 |
| Comparative Example 27 | 1.17 | — | 1.13 | 24 hr | 0.15 | 0.15 |
| Comparative Example 28 | 1.10 | — | 0.40 | 22 hr | 0.14 | 0.15 |
| Comparative Example 29 | 0.93 | — | 0.75 | 24 hr | 0.15 | 0.15 |

Note)
The symbol "—" means that the optical density did not decrease to lower than 0.15.

Examples where reversible color developers represented by the formula (6) were used.

EXAMPLE 59

(A) Preparation of reversible heat sensitive coating liquid:

40 Parts of 3-di-n-butylamino-6-methyl-7-anilinofluoran as a dye precursor was ground together with 90 parts of a 2.5% aqueous polyvinyl alcohol solution for 24 hours by a ball mill to obtain a dye precursor dispersion. Then, 100 parts of n-octadecylsuccinic acid [N-(4-hydroxyphenyl] imide was ground together with 400 parts of a 2.5% aqueous polyvinyl alcohol solution for 24 hours by a ball mill to obtain a dispersion. These two dispersions were mixed, and 200 parts of a 10% aqueous polyvinyl alcohol solution and 400 parts of water were added to the resulting mixture, followed by well mixing them to obtain a reversible heat sensitive coating liquid.

(B) Preparation of reversible heat sensitive recording material:

The reversible heat sensitive coating liquid prepared in the above (A) was coated on a polyethylene terephthalate (PET) sheet at a solid coating amount of 4 g/m$^2$, and dried, and then the coat was supercalendered to obtain a reversible heat sensitive recording material.

EXAMPLE 60

A reversible heat sensitive recording material was obtained in the same manner as in Example 59, except that (n-octadecylthio)succinic acid [N-(4-hydroxyphenyl)]imide was used in place of n-octadecylsuccinic acid [N-(4-hydroxyphenyl)]imide.

COMPARATIVE EXAMPLE 30

A reversible heat sensitive recording material was obtained in the same manner as in Example 59, except that a salt of gallic acid and stearylamine was used in place of n-octadecylsuccinic acid [N-(4-hydroxyphenyl)]imide.

COMPARATIVE EXAMPLE 31

A reversible heat sensitive recording material was obtained in the same manner as in Example 59, except that 2,2-bis(4-hydroxyphenyl)propane was used in place of n-octadecylsuccinic acid [N-(4-hydroxyphenyl)]imide.

COMPARATIVE EXAMPLE 32

A reversible heat sensitive recording material was obtained in the same manner as in Example 59, except that p-(n-octadecylthio)phenol was used in place of n-octadecylsuccinic acid [N-(4-hydroxyphenyl)]imide.

Test 10 (Image erasability 2)

The heat sensitive recording materials obtained in Examples 59 and 60 and Comparative Examples 30–32 were printed by a heat sensitive facsimile printing tester TH-PMD (manufactured by Ohkura Electric Co., Ltd.) having a printing head KJT-256-8MGF1 (manufactured by Kyocera Co., Ltd.) under conditions of an applied pulse of 1.1 msec and an applied voltage of 26 volts, and the resulting color formed image portion was heated at 120° C. for 1 second by a hot stamp and, then, density was measured in the same manner as in Test 1.

The results of Test 1 and Test 10 on the recording materials of Examples 59 and 60 and Comparative Examples 30-32 are shown in Table 8.

TABLE 8

| | Test 1 Density of color formed portion | Test 10 Density of erased portion | Contrast |
|---|---|---|---|
| Example 59 | 1.21 | 0.16 | ○ |
| Example 60 | 1.23 | 0.13 | ○ |
| Comparative Example 30 | 0.47 | 0.23 | Δ |
| Comparative Example 31 | 1.37 | 1.28 | x |
| Comparative Example 32 | 0.68 | 026 | Δ |

In Table 8, ○ means that the density of the erased portion was less than 20% of the density of the color formed portion and the contrast between the color formed portion and the erased portion was good, Δ means that the density of the erased portion was 20% or more and less than 80% of the density of the color formed portion and the contrast was insufficient, and x means that the density of the erased portion was 80% or more of the density of the color formed portion and reversibility was not recognized.

As shown in Tables 1–6, when a compound represented by the formulas (1)–(5) is contained in a reversible heat sensitive recording material which contains a normally colorless or light colored dye precursor and a reversible color developer which causes reversible color change in said dye precursor upon heating, a reversible heat sensitive recording material capable of forming an image and erasing the image with a clear contrast and capable of retaining stable images with time under the conditions of daily living can be obtained.

Furthermore, as is clear from Table 7, by combining the reversible color developer represented by the formula (6)

with the compound represented by the formula (1) or (4) as a color erasion accelerator, there is obtained a highly practical reversible heat sensitive recording material in which the recorded images can be erased by simple methods, such as leaving it in natural environment or at relatively low temperatures or heating it by a drier.

We claim:

1. A heat sensitive recording material comprising a support and, provided thereon, a normally colorless or light colored dye precursor and a reversible color developer which causes reversible change of color tone in the dye precursor due to the difference in cooling rate after heating, said reversible heat sensitive recording material containing at least one of the compounds represented by the following formula (1)–(5);

$$A\text{-}(R^a)_h\text{-}X^a\text{—}R^b \quad (1)$$

in the formula 1, A represents a substituent having at least one nitrogen atom, $R^a$ represents a divalent hydrocarbon group of 1–12 carbon atoms, $x^a$ represents a divalent group having at least one —COHN— bond, $R^b$ represents a hydrocarbon group of 1–24 carbon atoms and may have one or more sulfur atoms in the group, with a proviso that when $R^b$ has no sulfur atom, $X^a$ does not contain simple urea bond, and h represents 0 or 1,

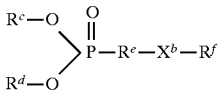

(2)

in the formula 2, $R^c$ and $R^d$ each represent a hydrocarbon group of 1–24 carbon atoms, $R^e$ represents a divalent hydrocarbon group of 1–12 carbon atoms, $R^f$ represents a hydrocarbon group of 1–28 carbon atoms and may have an oxygen atom or sulfur atom in the group, and $X^b$ represents a divalent group having at least one —COHN— bond,

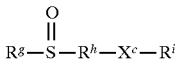

(3)

in the formula 3, $R^g$ and $R^i$ each represent a hydrocarbon group of 1–24 carbon atoms, $R^h$ represents a divalent hydrocarbon group of 1–12 carbon atoms, and $X^c$ represents a divalent group having at least one —COHN— bond,

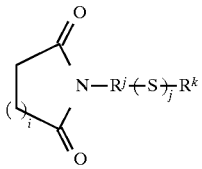

(4)

in the formula 4, $R^j$ represents a divalent hydrocarbon group of 1–12 carbon atoms, $R^k$ represents a hydrocarbon group of 1–24 carbon atoms, i represents an integer of 1 to 3, and j represents 0 or 1, $$R^1\text{-}(S\text{—}R^m)_k\text{-}X^d \quad (5)$$

in the formula 5, $R^1$ represents a hydrocarbon group of 1–24 carbon atoms, $R^m$ represents a divalent hydrocarbon group of 1–12 carbon atoms, $X^d$ represents a monovalent group having at least one —COHN— bond, and k represents 0 or 1, with a proviso that in the case of k=0, $X^d$ does not contain simple amide bond.

2. A reversible heat sensitive recording material according to claim 1 which contains at least one compound represented by the formula (1) as a color erasion accelerator.

3. A reversible heat sensitive recording material according to claim 1 which contains a compound represented by the formula (2) as a color erasion accelerator.

4. A reversible heat sensitive recording material according to claim 1 which contains a compound represented by the formula (3) as a color erasion accelerator.

5. A reversible heat sensitive recording material according to claim 1 which contains a compound represented by the formula (4) as a color erasion accelerator.

6. A reversible heat sensitive recording material according to claim 1 which contains a compound represented by the formula (5) as a color erasion accelerator.

7. A heat sensitive recording material comprising a support and, provided thereon, a normally colorless or light colored dye precursor and a reversible color developer represented by the following formula (6) which causes reversible change of color tone in the dye precursor by heating:

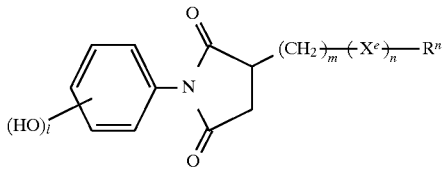

(6)

in the formula 6, represents an integer of 1 to 3, m represents an integer of 0 to 3, $X^e$ represents an oxygen atom or a sulfur atom, n represents 0 or 1, and $R^n$ represents a hydrocarbon group of 10–24 carbon atoms.

8. A reversible heat sensitive recording material according to claim 7 which additionally contains a compound represented by the formula (1) or (4) as a color erasion accelerator.

9. A heat sensitive recording material according to claim 1, wherein $X^a$ does not contain an urea bond moiety directly attached to $R^b$.

10. A heat sensitive recording material according to claim 1, wherein $R^b$ contains one or more sulfur atoms.

* * * * *